US006377916B1

(12) United States Patent
Hardwick

(10) Patent No.: US 6,377,916 B1
(45) Date of Patent: Apr. 23, 2002

(54) MULTIBAND HARMONIC TRANSFORM CODER

(75) Inventor: John C. Hardwick, Sudbury, MA (US)

(73) Assignee: Digital Voice Systems, Inc., Burlington, MA (US)

( * ) Notice: Subject to any disclaimer, the term of this patent is extended or adjusted under 35 U.S.C. 154(b) by 0 days.

(21) Appl. No.: 09/447,958

(22) Filed: Nov. 29, 1999

(51) Int. Cl.[7] ..... G10L 11/06
(52) U.S. Cl. ..... 704/208; 704/230; 704/265
(58) Field of Search ..... 204/208, 205, 204/207, 204, 209, 214, 216, 217, 218, 222, 224, 230, 258, 200.1, 263, 264, 265, 266

(56) References Cited

U.S. PATENT DOCUMENTS

| | | | |
|---|---|---|---|
| 3,706,929 | A | 12/1972 | Robinson et al. |
| 3,975,587 | A | 8/1976 | Dunn et al. |
| 3,982,070 | A | 9/1976 | Flanagan |
| 4,091,237 | A | 5/1978 | Wolnowsky et al. |
| 4,422,459 | A | 12/1983 | Simson |
| 4,583,549 | A | 4/1986 | Manoli |
| 4,618,982 | A | 10/1986 | Horvath et al. |
| 4,622,680 | A | 11/1986 | Zinser |
| 4,720,861 | A | 1/1988 | Bertrand |
| 4,797,926 | A | 1/1989 | Bronson et al. |
| 4,821,119 | A | 4/1989 | Gharavi |
| 4,879,748 | A | 11/1989 | Picone et al. |
| 4,885,790 | A | 12/1989 | McAulay et al. |
| 4,979,110 | A | 12/1990 | Albrecht et al. |
| 5,023,910 | A | 6/1991 | Thomson |
| 5,036,515 | A | 7/1991 | Freeburg |
| 5,054,072 | A | 10/1991 | McAulay et al. |
| 5,067,158 | A | 11/1991 | Arjmand |
| 5,081,681 | A | 1/1992 | Hardwick et al. |
| 5,091,944 | A | 2/1992 | Takahashi |
| 5,095,392 | A | 3/1992 | Shimazaki et al. |
| 5,195,166 | A | 3/1993 | Hardwick et al. |
| 5,216,747 | A | 6/1993 | Hardwick et al. |
| 5,226,084 | A | 7/1993 | Hardwick et al. |

(List continued on next page.)

FOREIGN PATENT DOCUMENTS

| | | | |
|---|---|---|---|
| EP | 123456 | 10/1984 | ..... H04N/7/12 |
| EP | 154381 | 9/1985 | ..... G10L/9/14 |
| EP | 0 833 305 | 4/1998 | ..... G10L/9/14 |
| WO | 92/05539 | 4/1992 | ..... G10L/7/02 |
| WO | 92/10830 | 6/1992 | ..... G10L/5/00 |

OTHER PUBLICATIONS

Almeida et al.; "Harmonic Coding: A Low Bit–Rate, Good–Quality Speech Coding Technique"; IEEE (1982); pp. 1664–1667.

(List continued on next page.)

*Primary Examiner*—Richemond Dorvil
(74) *Attorney, Agent, or Firm*—Fish & Richardson P.C.

(57) ABSTRACT

A speech signal is encoded into a set of encoded bits by digitizing the speech signal to produce a sequence of digital speech samples that are divided into a sequence of frames, each of which spans multiple digital speech samples. A set of speech model parameters are estimated for a frame. The speech model parameters include voicing parameters dividing the frame into voiced and unvoiced regions, at least one pitch parameter representing pitch for at least the voiced regions of the frame, and spectral parameters representing spectral information for at least the voiced regions of the frame. The speech model parameters are quantized to produce parameter bits. The frame is also divided into one or more subframes for which transform coefficients are computed. The transform coefficients for unvoiced regions of the frame are quantized to produce transform bits. The parameter bits and the transform bits are included in the set of encoded bits.

42 Claims, 9 Drawing Sheets

U.S. PATENT DOCUMENTS

| | | | | | |
|---|---|---|---|---|---|
| 5,226,108 | A | | 7/1993 | Hardwick et al. | |
| 5,247,579 | A | | 9/1993 | Hardwick et al. | |
| 5,265,167 | A | | 11/1993 | Akamine et al. | |
| 5,517,511 | A | | 5/1996 | Hardwick et al. | |
| 5,517,595 | A | * | 5/1996 | Kleijn | 704/205 |
| 5,778,334 | A | | 7/1998 | Ozawa et al. | |
| 5,806,038 | A | | 9/1998 | Huang et al. | |
| 5,890,108 | A | * | 3/1999 | Yeldener | 704/200.1 |
| 5,960,388 | A | * | 9/1999 | Nishiguchi et al. | 704/208 |
| 6,094,629 | A | * | 7/2000 | Grabb et al. | 704/206 |
| 6,119,082 | A | * | 9/2000 | Zinser et al. | 704/219 |
| 6,131,084 | A | * | 10/2000 | Hardwick | 704/222 |
| 6,138,092 | A | * | 10/2000 | Zinser et al. | 704/208 |
| 6,161,089 | A | * | 12/2000 | Hardwick | 704/219 |
| 6,199,037 | B1 | * | 3/2001 | Hardwick | 704/208 |

OTHER PUBLICATIONS

Almeida et al.; "Variable–Frequency Synthesis: An Improved Harmonic Coding Scheme"; ICASSP (1984); pp. 27.5.1–27.5.4.

Atungsiri et al.; "Error Detection and Control for the Parametric Information in CELP Coders"; IEEE (1990); pp. 229–232.

Brandstein et al.; "A Real–Time Implementation of the Improved MBE Speech Coder"; IEEE (1990); pp. 5–8.

Campbell et al.; "The New 4800 bps Voice Coding Standard"; Mil Speech Conference (Nov. 1989); pp. 64–70.

Chen et al.; "Real–Time Vector APC Speech Coding at 4800 bps with Adaptive Postfiltering"; Proc. ICASSP (1987); pp. 2185–2188.

Cox et al.; "Subband Speech Coding and Matched Convolutional Channel Coding for Mobile Radio Channels"; IEEE Trans. Signal Proc., vol. 39(8); Aug. 1991; pp. 1717–1731.

Digital Voice Systems, Inc.; "INMARSAT–M Voice Codec"; Version 1.9; Nov. 18, 1992; pp. 1–145.

Digital Voice Systems, Inc.; "The DVSI IMBE Speech Compression System"; advertising brochure (May 12, 1993).

Digital Voice Systems, Inc.; "The DVSI IMBE Speech Coder"; advertising brochure (May 12, 1993).

Flanagan, J.L.; Speech Analysis and Perception; Springer–Verlag (1982); pp. 378–386.

Fujimura; "An Approximation to Voice Aperiodicity"; IEEE Transactions on Audio and Electroacoutics, vol. AU–16(1); Mar. 1968; pp. 68–72.

Griffin et al.; "A High Quality 9.6 Kbps Speech Coding System"; Proc. ICASSP 86; Tokyo, Japan; Apr. 13–20, 1986; pp. 125–128.

Griffin et al.; "A New Model–Based Speech Analysis/Synthesis System"; Proc. ICASSP 85; Tampa, FL; Mar. 26–29, 1985; pp. 513–516.

Griffin et al.; "A New Pitch Detection Algorithm"; Digital Signal Processing, No. 84; Elsevier Science Publishers; 1984; pp. 395–399.

Griffin et al.; "Multiband Excitation Vocoder"; IEEE Transactions on Acoustics, Speech and Signal Processing, vol. 36(8); 1988; pp. 1223–1235.

Griffin; "The Multiband Excitation Vocoder"; Ph.D. Thesis; M.I.T.; 1987.

Griffin et al.; "Signal Estimation from Modified Short–Time Fourier Transform"; IEEE Transactions on Acoustics, Speech, and Signal Processing, vol. ASSP–32(2); Apr. 1984; pp. 236–243.

Hardwick et al.; "A 4.8 Kbps Multi–band Excitation Speech Coder"; Proceedings from ICASSP, International Conference on Acoustics, Speech and Signal Processing, New York, NY; Apr. 11–14, 1988; pp. 374–377.

Hardwick et al.; "A 4.8 Kbps Multi–Band Excitation Speech Coder"; Master's Thesis, M.I.T.; 1988.

Hardwick et al.; "The Application of the IMBE Speech Coder to Mobile Communications"; IEEE; 1991; pp. 249–252.

Heron; "A 32–Band Sub–band/Transform Coder Incorporating Vector Quantization for Dynamic Bit Allocation"; IEEE; 1983; pp. 1276–1279.

Levesque et al.; "A Proposed Federal Standard for Narrowband Digital Land Mobile Radio"; IEEE; 1990; pp. 497–507.

Makhoul; "A Mixed–Source Model For Speech Compression and Synthesis"; IEEE; 1978; pp. 163–166.

Makhoul; "Vector Quantization in Speech Coding"; Proc. IEEE; 1985; pp. 1551–1588.

Maragos et al.; "Speech Nonlinearities, Modulations, and Energy Operators"; IEEE; 1991; pp. 421–424.

Mazor et al.; "Transform Subbands Coding With Channel Error Control"; IEEE; 1989; pp. 172–175.

McAulay et al.; "Mid–Rate Coding Based on a Sinusoidal Representation of Speech"; Proc. IEEE; 1985; pp. 945–948.

McAulay et al.; Multirate Sinusoidal Transform Coding at Rates From 2.4 Kbps to 8 Kbps; IEEE; 1987; pp. 1645–1648.

McAulay et al.; "Speech Analysis/Synthesis Based on a Sinusoidal Representation"; IEEE Transactions on Acoustics, Speech and Signal Processing, vol. 34(4); Aug. 1986; pp. 744–754.

McCree et al.; "A New Mixed Excitation LPC Vocoder"; IEEE; 1991; pp. 593–595.

McCree et al.; "Improving the Performance of a Mixed Excitation LPC Vocoder In Acoustic Noise"; IEEE; 1992; pp. 137–139.

Rahikka et al.; "CELP Coding for Land Mobile Radio Applications"; Proc. ICASSP 90; Albuquerque, NM; Apr. 3–6, 1990; pp. 465–468.

Rowe et al.; "A Robust 2400 bit/s MBE–LPC Speech Coder Incorporating Joint Source and Channel Coding"; IEEE; 1992; pp. 141–144.

Secrest et al.; "Postprocessing Techniques for Voice Pitch Trackers"; ICASSP, vol. 1; 1982; pp. 172–175.

Tribolet et al.; "Frequency Domain Coding of Speech"; IEEE Transactions on Acoustics, Speech and Signal Processing, vol. ASSP–27(5); Oct. 1979; pp. 512–530.

Yu et al.; "Discriminant Analysis and Supervised Vector Quantization for Continuous Speech Recognition"; IEEE; 1990; pp. 685–688.

* cited by examiner

MULTIBAND HARMONIC TRANSFORM CODER

TECHNICAL FIELD

The invention is directed to encoding and decoding speech or other audio signals.

BACKGROUND

Speech encoding and decoding have a large number of applications and have been studied extensively. In general, speech coding, which is often referred to as speech compression, seeks to reduce the data rate needed to represent a speech signal without substantially reducing the quality or intelligibility of the speech. Speech compression techniques may be implemented by a speech coder.

A speech coder is generally viewed as including an encoder and a decoder. The encoder produces a compressed stream of bits from a digital representation of speech, which may be generated by using an analog-to-digital converter to sample and digitize an analog speech signal produced by a microphone. The decoder converts the compressed bit stream into a digital representation of speech that is suitable for playback through a digital-to-analog converter and a speaker. In many applications, the encoder and decoder are physically separated, and the bit stream is transmitted between them using a communication channel. Alternatively, the bit stream may be stored in a computer or other memory for decoding and playback at a later time.

A key parameter of a speech coder is the amount of compression the coder achieves, which is measured by the bit rate of the stream of bits produced by the encoder. The bit rate of the encoder is generally a function of the desired fidelity (i.e., speech quality) and the type of speech coder employed. Different types of speech coders have been designed to operate at different bit rates. Medium to low rate speech coders operating below 10 kbps (kilobits per second) have received attention with respect to a wide range of mobile communication applications, such as cellular telephony, satellite telephony, land mobile radio, and in-flight telephony. These applications typically require high quality speech and robustness to artifacts caused by acoustic noise and channel noise (e.g., bit errors).

A well known approach for coding speech at medium to low data rates is based around linear predictive coding (LPC), which attempts to predict each new frame of speech from previous samples using short and/or long term predictors. The prediction error is typically quantized using one of several approaches of which CELP and/or multi-pulse are two examples. The linear prediction method has good time resolution, which is helpful for the coding of unvoiced sounds. In particular, plosives and transients benefit from the time resolution in that they are not overly smeared in time. However, linear prediction often has difficulty for voiced sounds, since the coded speech tends to sound rough or hoarse due to insufficient periodicity in the coded signal. This is particularly true at lower data rates, which typically require a longer frame size and employ a long-term predictor that is less effective at reproducing the periodic portion (i.e., the voiced portion) of speech.

Another well known approach for low to medium rate speech coding is a model-based speech coder, which is often referred to as a vocoder. A vocoder usually models speech as the response of some system to an excitation signal over short time intervals. Examples of vocoder systems include linear prediction vocoders, such as MELP or LPC-10, homomorphic vocoders, channel vocoders, sinusoidal transform coders ("STC"), harmonic vocoder and multiband excitation ("MBE") vocoders. In these vocoders, speech is divided into short segments (typically 10–40 ms), and each segment is characterized by a set of model parameters. These parameters typically represent a few basic elements of each speech segment, such as the segment's pitch, voicing state, and spectral envelope. A vocoder may use one of a number of known representations for each of these parameters. For example, the pitch may be represented as a pitch period, a fundamental frequency, or a long-term prediction delay. Similarly, the voicing state may be represented by one or more voicing metrics, by a voicing probability measure, or by a ratio of periodic to stochastic energy. The spectral envelope is often represented by an all-pole filter response, but also may be represented by a set of spectral magnitudes, cepstral coefficients, or other spectral measurements.

Since they permit a speech segment to be represented using only a small number of parameters, model-based speech coders, such as vocoders, typically are able to operate at lower data rates. However, the quality of a model-based system is dependent on the accuracy of the underlying model. Accordingly, a high fidelity model must be used if these speech coders are to achieve high speech quality.

One vocoder which has been shown to work well for certain types of speech is the harmonic vocoder. The harmonic vocoder is generally able to accurately model voiced speech, which is generally periodic over some short time interval. The harmonic vocoder represents each short segment of speech with a pitch period and some form of vocal tract response. Often, one or both of these parameters are converted into the frequency domain, and represented as a fundamental frequency and a spectral envelope. A speech segment can be synthesized in a harmonic vocoder by summing a sequence of harmonically related sine waves having frequencies at multiples of the fundamental frequency and amplitudes matching the spectral envelope. Harmonic vocoders often have difficult handling unvoiced speech, which is not easily modeled with a sparse collection of sine waves. Early harmonic vocoders handled unvoiced speech indirectly, without the use of any explicit voicing information, through a residual signal computed from the difference between the original speech and the harmonically-modeled speech. This residual signal was coded along with the model parameters, which lead to a relatively high total bit rate, or it was dropped, which led to relatively low quality. In another approach, a single voiced/unvoiced decision was used for an entire frame, with model parameters being added for voiced frames and the spectrum being coded for unvoiced frames. Problems with this approach resulted from the insufficiency of a single voicing decision for the entire frame (many segments of speech are voiced in some regions while being unvoiced in other regions), and from the sensitivity of the system to a voicing error which would negatively affect the entire frame. Previous harmonic coding schemes also suffered from the need to code the harmonic phases for voiced speech, and from not using critically sampled spectral representations for the unvoiced speech. These limitations reduced the number of bits available to code the other parameters, such as the harmonic magnitudes. As a result, the frame sizes were increased to around 30 ms to ensure that sufficient bits were available for all of the parameters at a reasonable total bit rate. Unfortunately, the use of a large frame size decreased time resolution in the system, which limited performance for unvoiced sounds and transients.

One improvement to early harmonic vocoders was introduced in the form of the Multiband Excitation (MBE)

speech model. This model combines a harmonic representation for voiced speech with a flexible, frequency-dependent voicing structure that allows it to produce natural sounding unvoiced speech, and which makes it more robust to the presence of acoustic background noise. These properties allow the MBE model to produce higher quality speech at low to medium data rates, and have led to its use in a number of commercial mobile communication applications.

The MBE speech model represents segments of speech using a fundamental frequency representing the pitch, a set of binary voiced/unvoiced (V/UV) decisions or other voicing metrics, and a set of spectral magnitudes representing the frequency response of the vocal tract. The MBE model generalizes the traditional single V/UV decision per segment into a set of decisions, each representing the voicing state within a particular frequency band or region. Each frame is thereby divided into voiced and unvoiced regions. This added flexibility in the voicing model allows the MBE model to better accommodate mixed voicing sounds, such as some voiced fricatives, allows a more accurate representation of speech that has been corrupted by acoustic background noise, and reduces the sensitivity to an error in any one decision. Extensive testing has shown that this generalization results in improved voice quality and intelligibility.

The encoder of an MBE-based speech coder estimates the set of model parameters for each speech segment. The MBE model parameters include a fundamental frequency (the reciprocal of the pitch period); a set of V/UV metrics or decisions that characterize the voicing state; and a set of spectral magnitudes that characterize the spectral envelope. After estimating the MBE model parameters for each segment, the encoder quantizes the parameters to produce a frame of bits. The encoder optionally may protect these bits with error correction/detection codes before interleaving and transmitting the resulting bit stream to a corresponding decoder.

The decoder converts the received bit stream back into individual frames. As part of this conversion, the decoder may perform deinterleaving and error control decoding to correct or detect bit errors. The decoder then uses the frames of bits to reconstruct the MBE model parameters, which the decoder uses to synthesize a speech signal that is perceptually close to the original speech. The decoder may synthesize separate voiced and unvoiced components, and then may add the voiced and unvoiced components to produce the final speech signal.

In MBE-based systems, the encoder uses a spectral magnitude to represent the spectral envelope at each harmonic of the estimated fundamental frequency. The encoder then estimates a spectral magnitude for each harmonic frequency. Each harmonic is designated as being either voiced or unvoiced, depending upon whether the frequency band containing the corresponding harmonic has been declared voiced or unvoiced. When a harmonic frequency has been designated as being voiced, the encoder may use a magnitude estimator that differs from the magnitude estimator used when a harmonic frequency has been designated as being unvoiced. However, the spectral magnitudes generally are estimated independently of the voicing decisions. To do this, the speech coder computes a fast Fourier transform ("FFT") for each windowed subframe of speech and averages the energy over frequency regions that are multiples of the estimated fundamental frequency. This approach may further include compensation to remove artifacts introduced by the FFT sampling grid from the estimated spectral magnitudes.

At the decoder, the voiced and unvoiced harmonics are identified, and separate voiced and unvoiced components are synthesized using different procedures. The unvoiced component may be synthesized using a weighted overlap-add method to filter a white noise signal. The filter used by the method sets to zero all frequency bands designated as voiced while otherwise matching the spectral magnitudes for regions designated as unvoiced. The voiced component is synthesized using a tuned oscillator bank, with one oscillator assigned to each harmonic that has been designated as being voiced. The instantaneous amplitude, frequency and phase are interpolated to match the corresponding parameters at neighboring segments. While early MBE-based systems included phase information in the bits received by the decoder, one significant improvement incorporated into later MBE-based systems is a phase synthesis method that allows the decoder to regenerate the phase information used in the synthesis of voiced speech without explicitly requiring any phase information to be transmitted by the encoder. Random phase synthesis based upon the voicing decisions may be applied, as in the case of the IMBE™ speech coder. Alternatively, the decoder may apply a smoothing kernel to the reconstructed spectral magnitudes to produce phase information that may be perceptually closer to that of the original speech than is the randomly produced phase information. Such phase regeneration methods allow more bits to be allocated to other parameters and enable shorter frame sizes, which increases time resolution.

MBE-based vocoders include the IMBE™ speech coder and the AMBE® speech coder. The AMBE® speech coder was developed as an improvement on earlier MBE-based techniques and includes a more robust method of estimating the excitation parameters (fundamental frequency and voicing decisions). The method is better able to track the variations and noise found in actual speech. The AMBE® speech coder uses a filter bank that typically includes sixteen channels and a non-linearity to produce a set of channel outputs from which the excitation parameters can be reliably estimated. The channel outputs are combined and processed to estimate the fundamental frequency. Thereafter, the channels within each of several (e.g., eight) voicing bands are processed to estimate a voicing decision (or other voicing metrics) for each voicing band.

Certain MBE-based vocoders, such as the AMBE® speech coder discussed above, are able to produce speech which sounds very close to the original speech. In particular voiced sounds are very smooth and periodic and do not exhibit the roughness or hoarseness typically associated with the linear predictive speech coders. Tests have shown that a 4 kbps AMBE® speech coder can equal the performance of CELP type coders operating at twice the rate. However the AMBE® vocoder still exhibits some distortion in unvoiced sounds due to excessive time spreading. This is due in part to the use in the unvoiced synthesis of an arbitrary white noise signal, which is uncorrelated with the original speech signal. This prevents the unvoiced component from localizing any transient sound within the segment. Hence, a short attack or small pulse of energy is spread out over the whole segment, which results in a "slushy" sound in the reconstructed signal.

The techniques noted above are described, for example, in: Flanagan, *Speech Analysis, Synthesis and Perception*, Springer-Verlag, 1972, pages 378–386 (describes a frequency-based speech analysis-synthesis system); Jayant et al., *Digital Coding of Waveforms*, Prentice-Hall, 1984 (describing speech coding in general); U.S. Pat. No. 4,885,790 (describes a sinusoidal processing method); U.S. Pat.

No. 5,054,072 (describes a sinusoidal coding method); Tribolet et al., "Frequency Domain Coding of Speech", *IEEE TASSP*, Vol. ASSP-27, No 5, October 1979, pages 512–530 (describes speech specific ATC); Almeida et al., "Nonstationary Modeling of Voiced Speech", *IEEE TASSP*, Vol. ASSP-31, No. 3, June 1983, pages 664–677, (describes harmonic modeling and an associated coder); Almeida et al., "Variable-Frequency Synthesis: An Improved Harmonic Coding Scheme", *IEEE Proc. ICASSP* 84, pages 27.5.1–27.5.4, (describes a polynomial voiced synthesis method); Rodrigues et al., "Harmonic Coding at 8 KBITS/SEC", Proc. ICASSP 87, pages 1621–1624, (describes a harmonic coding method); Quatieri et al., "Speech Transformations Based on a Sinusoidal Representation", *IEEE TASSP*, Vol. ASSP-34, No. 6, December 1986, pages 1449–1986 (describes an analysis-synthesis technique based on a sinusoidal representation); McAulay et al., "Mid-Rate Coding Based on a Sinusoidal Representation of Speech", Proc. *ICASSP* 85, pages 945–948, Tampa, Fla, Mar. 26–29, 1985 (describes a sinusoidal transform speech coder); Griffin, "Multiband Excitation Vocoder", Ph.D. Thesis, M.I.T, 1988 (describes the MBE speech model and an 8000 bps MBE speech coder); Hardwick, "A 4.8 kbps Multi-Band Excitation Speech Coder", SM. Thesis, M.I.T, May 1988 (describes a 4800 bps MBE speech coder); Hardwick, "The Dual Excitation Speech Model", Ph.D. Thesis, M.I.T, 1992 (describes the dual excitation speech model); Princen et al., "Subband/Transform Coding Using Filter Bank Designs Based on Time Domain Aliasing Cancellation", IEEE Proc. ICASSP '87, pages 2161–2164 (describes modified cosine transform using TDAC principles); Telecommunications Industry Association (TIA), "APCO Project 25 Vocoder Description", Version 1.3, Jul. 15, 1993, IS102BABA (describes a 7.2 kbps IMBE™ speech coder for APCO Project 25 standard), all of which are incorporated by reference.

SUMMARY

The invention provides improved coding techniques for speech or other signals. The techniques combine a multiband harmonic vocoder for voiced sounds with a new method for coding unvoiced sounds which is better able to handle transients. This results in improved speech quality at lower data rates. The techniques have wide applicability to digital voice communications including such applications as cellular telephony, digital radio, and satellite communications.

In one general aspect, the techniques feature encoding a speech signal into a set of encoded bits. The speech signal is digitized to produce a sequence of digital speech samples that are divided into a sequence of frames, with each of the frames spanning multiple digital speech samples. A set of speech model parameters then is estimated for a frame. The speech model parameters include voicing parameters dividing the frame into voiced and unvoiced regions, at least one pitch parameter representing pitch for at least the voiced regions of the frame, and spectral parameters representing spectral information for at least the voiced regions of the frame. The speech model parameters are quantized to produce parameter bits.

The frame is also divided into one or more subframes, and transform coefficients are computed for the digital speech samples representing the subframes. The transform coefficients in unvoiced regions of the frame are quantized to produce transform bits. The parameter bits and the transform bits are included in the set of encoded bits.

Embodiments may include one or more of the following features. For example, when the frame is divided into frequency bands, and the voicing parameters include binary voicing decisions for frequency bands of the frame, the division into voiced and unvoiced regions may designate at least one frequency band as being voiced and one frequency band as being unvoiced. For some frames, all of the frequency bands may be designated as voiced or all may be designated as unvoiced.

The spectral parameters for the frame may include one or more sets of spectral magnitudes estimated for both voiced and unvoiced regions in a manner which is independent of the voicing parameters for the frame. When the spectral parameters for the frame include two or more sets of spectral magnitudes, they may be quantized by companding all sets of spectral magnitudes in the frame to produce sets of companded spectral magnitudes using a companding operation such as the logarithm, quantizing the last set of the companded spectral magnitudes in the frame, interpolating between the quantized last set of companded spectral magnitudes in the frame and a quantized set of companded spectral magnitudes from a prior frame to form interpolated spectral magnitudes, determining a difference between a set of companded spectral magnitudes and the interpolated spectral magnitudes, and quantizing the determined difference between the spectral magnitudes. The spectral magnitudes may be computed by windowing the digital speech samples to produce windowed speech samples, computing an FFT of the windowed speech samples to produce FFT coefficients, summing energy in the FFT coefficients around multiples of a fundamental frequency corresponding to the pitch parameter, and computing the spectral magnitudes as square roots of the summed energies.

The transform coefficients may be computed using a transform possessing critical sampling and perfect reconstruction properties. For example, the transform coefficients may be computed using an overlapped transform that computes transform coefficients for neighboring subframes using overlapping windows of the digital speech samples.

The quantizing of the transform coefficients to produce transform bits may include computing a spectral envelope for the subframe from the model parameters, forming multiple sets of candidate coefficients, with each set of candidate coefficients being formed by combining one or more candidate vectors and multiplying the combined candidate vectors by the spectral envelope, selecting from the multiple sets of candidate coefficients the set of candidate coefficients which is closest to the transform coefficients, and including the index of the selected set of candidate coefficients in the transform bits. Each candidate vector may be formed from an offset into a known prototype vector and a number of sign bits, with each sign bit changing the sign of one or more elements of the candidate vector. The selected set of candidate coefficients may be the set from the multiple sets of candidate coefficients with the highest correlation with the transform coefficients.

Quantizing of the transform coefficients to produce transform bits may further include computing a best scale factor for the selected candidate vectors of the subframe, quantizing the scale factors for the subframes in the frame to produce scale factor bits, and including the scale factor bits in the transform bits. Scale factors for different subframes in the frame may be jointly quantized to produce the scale factor bits. The joint quantization may use a vector quantizer.

The number of bits in the set of encoded bits for one frame in the sequence of frames may be different than the number of bits in the set of encoded bits for a second frame in the sequence of frames. To this end, the encoding may further include selecting the number of bits in the set of encoded bits, wherein the number may vary from frame to frame, and allocating the selected number of bits between the parameters bits and the transform bits. Selecting the number of bits in the set of encoded bits for a frame may be based at least in part on the degree of change between the spectral magnitude parameters representing the spectral information in the frame and the previous spectral magnitude parameters representing the spectral information in the previous frame. A greater number of bits may be favored when the degree of change is larger, and a smaller number of bits may be favored when the degree of change is smaller.

The encoding techniques may be implemented by an encoder. The encoder may include a dividing element that divides the digital speech samples into a sequence of frames, each of the frames including multiple digital speech samples, and a speech model parameter estimator that estimates a set of speech model parameters for a frame. The speech model parameters may include voicing parameters dividing the frame into voiced and unvoiced regions, at least one pitch parameter representing pitch for at least the voiced regions of the frame, and spectral parameters representing spectral information for at least the voiced regions of the frame. The encoder also may include a parameter quantizer that quantizes the model parameters to produce parameter bits, a transform coefficient generator that divides the frame into one or more subframes and computes transform coefficients for the digital speech samples representing the subframes, a transform coefficient quantizer that quantizes the transform coefficients in unvoiced regions of the frame to produce transform bits, and a combiner that combines the parameter bits and the transform bits to produce the set of encoded bits. One, more than one, or all of the elements of the encoder may be implemented by a digital signal processor.

In another general aspect, a frame of digital speech samples is decoded from a set of encoded bits by extracting model parameter bits from the set of encoded bits and reconstructing model parameters representing the frame of digital speech samples from the extracted model parameter bits. The model parameters include voicing parameters dividing the frame into voiced and unvoiced regions, at least one pitch parameter representing the pitch information for at least the voiced regions of the frame, and spectral parameters representing spectral information for at least the voiced regions of the frame. Voiced speech samples for the frame are reproduced from the reconstructed model parameters.

Transform coefficient bits are also extracted from the set of encoded bits. Transform coefficients representing unvoiced regions of the frame are reconstructed from the extracted transform coefficient bits. The reconstructed transform coefficients are inverse transformed to produce inverse transform samples from which unvoiced speech for the frame is produced. The voiced speech for the frame and the unvoiced speech for the frame are combined to produce the decoded frame of digital speech samples.

Embodiments may include one or more of the following features. For example, when the frame is divided into frequency bands, and the voicing parameters include binary voicing decisions for frequency bands of the frame, the division into voiced and unvoiced regions designates at least one frequency band as being voiced and one frequency band as being unvoiced.

The pitch parameter and the spectral parameters for the frame may include one or more fundamental frequencies and one or more sets of spectral magnitudes. The voiced speech samples for the frame may be produced using synthetic phase information computed from the spectral magnitudes, and may be produced at least in part by a bank of harmonic oscillators. For example, a low frequency portion of the voiced speech samples may be produced by a bank of harmonic oscillators and a high frequency portion of the voiced speech samples may be produced using an inverse FFT with interpolation, wherein the interpolation is based at least in part on the pitch information for the frame.

The decoding may further include dividing the frame into subframes, separating the reconstructed transform coefficients into groups, each group of reconstructed transform coefficients being associated with a different subframe in the frame, inverse transforming the reconstructed transform coefficients in a group to produce inverse transform samples associated with the corresponding subframe, and overlapping and adding the inverse transform samples associated with consecutive subframes to produce unvoiced speech for the frame. The inverse transform samples may be computed using the inverse of an overlapped transform possessing both critical sampling and perfect reconstruction properties.

The reconstructed transform coefficients may be produced from the transform coefficient bits by computing a spectral envelope from the reconstructed model parameters, reconstructing one or more candidate vectors from the transform coefficient bits, and forming reconstructed transform coefficients by combining the candidate vectors and multiplying the combined candidate vectors by the spectral envelope. A candidate vector may be reconstructed from the transform coefficient bits by use of an offset into a known prototype vector and a number of sign bits, wherein each sign bit changes the sign of one or more elements of the candidate vector.

The decoding techniques may be implemented by a decoder. The decoder may include a model parameter extractor that extracts model parameter bits from the set of encoded bits and a model parameter reconstructor that reconstructs model parameters representing the frame of digital speech samples from the extracted model parameter bits. The model parameters may include voicing parameters dividing the frame into voiced and unvoiced regions, at least one pitch parameter representing the pitch information for at least the voiced regions of the frame, and spectral parameters representing spectral information for at least the voiced regions of the frame. The decoder also may include a voiced speech synthesizer that produces voiced speech samples for the frame from the reconstructed model parameters, a transform coefficient extractor that extracts transform coefficient bits from the set of encoded bits, a transform coefficient reconstructor that reconstructs transform coefficients representing unvoiced regions of the frame from the extracted transform coefficient bits, an inverse transformer that inverse transforms the reconstructed transform coefficients to produce inverse transform samples, an unvoiced speech synthesizer that synthesizes unvoiced speech for the frame from the inverse transform samples, and a combiner that combines the voiced speech for the frame and the unvoiced speech for the frame to produce the decoded frame of digital speech samples. One, more than one, or all of the elements of the encoder may be implemented by a digital signal processor.

In another general aspect, speech model parameters including a voicing parameter, at least one pitch parameter representing pitch for a frame, and spectral parameters representing spectral information for the frame are estimated and quantized to produce parameter bits. The frame is then divided into one or more subframes and transform coefficients for the digital speech samples representing the subframes are computed using a transform possessing critical sampling and perfect reconstruction properties. At least some of the transform coefficients are quantized to produce transform bits that are included with the parameter bits in a set of encoded bits.

In yet another general aspect, a frame of digital speech samples is decoded from a set of encoded bits by extracting model parameter bits from the set of encoded bits, reconstructing model parameters representing the frame of digital speech samples from the extracted model parameter bits, and producing voiced speech samples for the frame using the reconstructed model parameters. In addition, transform coefficient bits are extracted from the set of encoded bits to reconstruct transform coefficients that are inverse transformed to produce inverse transform samples. The inverse transform samples are produced using the a inverse of an overlapped transform possessing both critical sampling and perfect reconstruction properties. Unvoiced speech for the frame is produced from the inverse transform samples, and is combined with the voiced speech to produce the decoded frame of digital speech samples.

In yet another general aspect, a speech signal is encoded into a set of encoded bits by digitizing the speech signal to produce a sequence of digital speech samples that are divided into a sequence of frames that each span multiple samples. A set of speech model parameters is estimated for a frame. The speech model parameters include a voicing parameter, at least one pitch parameter representing pitch for the frame, and spectral parameters representing spectral information for the frame, the spectral parameters including one or more sets of spectral magnitudes estimated in a manner which is independent of the voicing parameter for the frame. The model parameters are quantized to produce parameter bits.

The frame is divided into one or more subframes and transform coefficients are computed for the digital speech samples representing the subframes. At least some of the transform coefficients are quantized to produce transform bits that are included with the parameter bits in the set of encoded bits.

In yet another general aspect, a frame of digital speech samples is decoded from a set of encoded bits. Model parameter bits are extracted from the set of encoded bits, and model parameters representing the frame of digital speech samples from the extracted model parameter bits are reconstructed. The model parameters include a voicing parameter, at least one pitch parameter representing pitch information for the frame, and spectral parameters representing spectral information for the frame. Voiced speech samples are produced for the frame using the reconstructed model parameters and synthetic phase information computed from the spectral magnitudes.

In addition, transform coefficient bits are extracted from the set of encoded bits, and transform coefficients are reconstructed from the extracted transform coefficient bits. The reconstructed transform coefficients are inverse transformed to produce inverse transform samples. Finally, unvoiced speech for the frame is produced from the inverse transform samples and combined with the voiced speech to produce the decoded frame of digital speech samples.

Other advantages will be apparent from the following description, including the drawings, and from the claims.

DESCRIPTION OF THE DRAWINGS

FIGS. 4–7are flow charts of procedures performed by the speech encoder of FIG. 1.

DESCRIPTION

Figure 1:
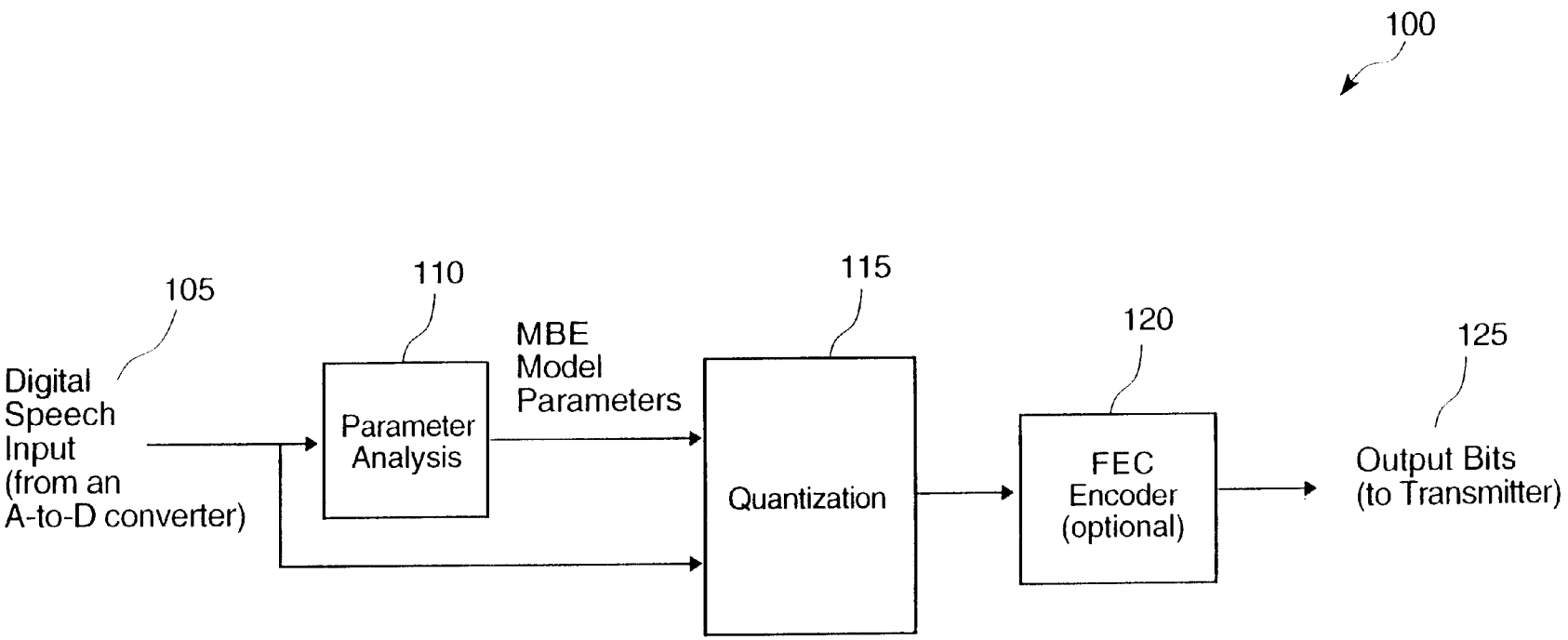
FIG. 1 is a simplified block diagram of a speech encoder.

Referring to FIG. 1, an encoder 100 processes digital speech 105 (or some other acoustic signal) that may be produced, for example, using a microphone and an analog-to-digital converter. The encoder processes this digital speech signal in short frames that are further divided into one or more subframes. In general, model parameters are estimated and processed by the encoder and decoder for each subframe. In one implementation, each 20 ms frame is divided into two 10 ms subframes, with the frame including 160 samples at a sampling rate of 8 kHz.

The encoder performs a parameter analysis 110 on the digital speech to estimate MBE model parameters for each subframe of a frame. The MBE model parameters include a fundamental frequency (the reciprocal of the pitch period) of the subframe; a set of binary voiced/unvoiced ("V/UV") decisions that characterize the voicing state of the subframe; and a set of spectral magnitudes that characterize the spectral envelope of the subframe.

Figure 2:
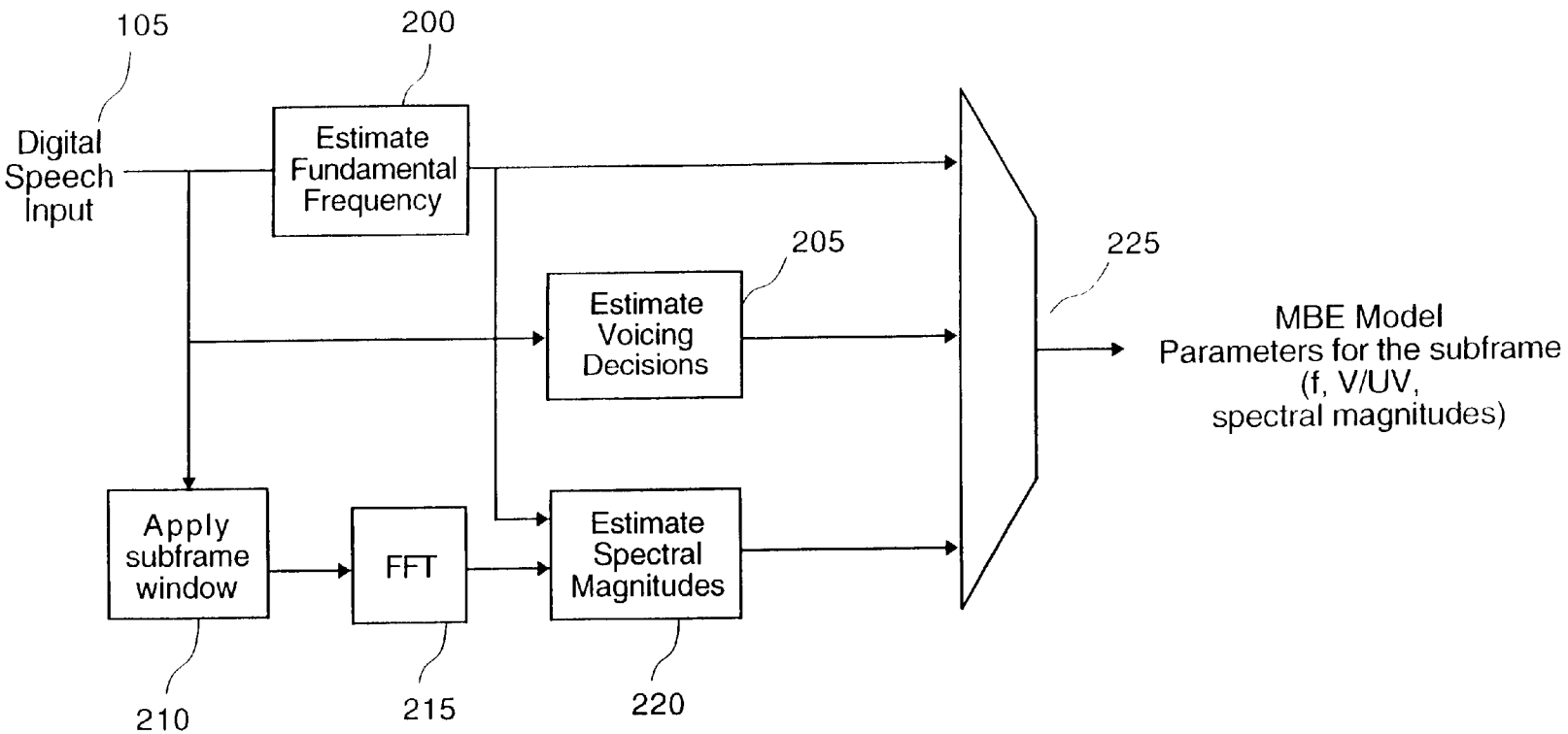
FIGS. 2 and 3 are block diagrams of, respectively, a parameter analysis block and a quantization block of the speech encoder of FIG. 1.

Referring also to FIG. 2, the MBE parameter analysis 110 includes processing the digital speech 105 to estimate the fundamental frequency 200 and to estimate voicing decisions 205. The parameter analysis 110 also includes applying a window function 210, such as a Hamming window, to the digital input speech. The output data of the window function 210 are transformed into spectral coefficients by an FFT 215. The spectral coefficients are processed together with the estimated fundamental frequency to estimate the spectral magnitudes 220. The estimated fundamental frequency, voicing decisions, and spectral magnitudes are combined 225 to produce the MBE model parameters for each subframe.

The parameter analysis 110 may employ a filterbank with a non-linear operator to estimate the fundamental frequency and voicing decisions for each subframe. The subframe is divided into N frequency bands (N=8 is typical), and one binary voicing decision is estimated per band. The binary voicing decisions represent the voicing state (i.e., 1=voiced, or 0=unvoiced) for each of the N frequency bands covering the bandwidth of interest (approximately 4 kHz for an 8 kHz sampling rate). The estimation of these excitation parameters is discussed in detail in U.S. Pat. Nos. 5,715,365 and 5,826,222, which are incorporated by reference. When the voicing decisions indicate that the entire frame is unvoiced, bits are saved by discarding the estimated fundamental frequency and replacing it with a default unvoiced fundamental frequency, which is typically set to approximately half the subframe rate (i.e., 200 Hz).

Once the excitation parameters are estimated, the encoder estimates a set of spectral magnitudes for each subframe. With two subframes per frame, two sets of spectral magnitudes are estimated for each frame. The spectral magnitudes are estimated for a subframe by windowing the speech signal using a short overlapping window such as a 155 point Hamming window, and computing an FFT (typically 256 points) on the windowed signal. The energy is then summed around each harmonic of the estimated fundamental frequency, and the square root of the sum is designated as the spectral magnitude for that harmonic. A particular method for estimating the spectral magnitudes is discussed in U.S. Pat. No. 5,754,974, which is incorporated by reference.

The voicing decisions, the fundamental frequency, and the set of spectral magnitudes for each of the two subframes form the model parameters for a frame. However, many variations in the model parameters and the methods used to estimate them are possible. These variations include using alternative or additional model parameters, or changing the rate at which the parameters are estimated. In one important variation, the voicing decisions and the fundamental frequency are only estimated once per frame. For example, those parameters may be estimated coincident with the last subframe of the current frame, and then interpolated for the first subframe of the current frame. Interpolation of the fundamental frequency may be accomplished by computing the geometric mean between the estimated fundamental frequencies for the last subframes of both the current frame and the immediately prior frame ("the prior frame"). Interpolation of the voicing decisions may be accomplished by a logical OR operation, which favors voiced over unvoiced, between the estimated decisions for last subframes of the current frame and the prior frame.

Referring again to FIG. 1, after performing the parameter analysis 110, the encoder employs a quantization block 115 to process the estimated model parameters and the digital speech to produce quantized bits for each frame. The encoder uses quantized MBE model parameters to represent voiced regions of a frame, while using separate MCT coefficients to represent unvoiced regions of the frame. The encoder then jointly quantizes the model parameters and coefficients for an entire frame using efficient joint quantization techniques.

Many different quantization methods can be used to quantize the model parameters. For example, the techniques have been successfully used with several methods which jointly quantize the excitation or spectral parameters between successive subframes. Such methods include the dual subframe spectral quantizers disclosed in U.S. patent application Ser. Nos. 08/818,130 and 08/818,137, which are incorporated by reference. Also, certain model parameters, such as the fundamental frequency and the voicing decisions, can be interpolated between subframes, to thereby reduce the amount of information that needs to be encoded.

Figure 3:
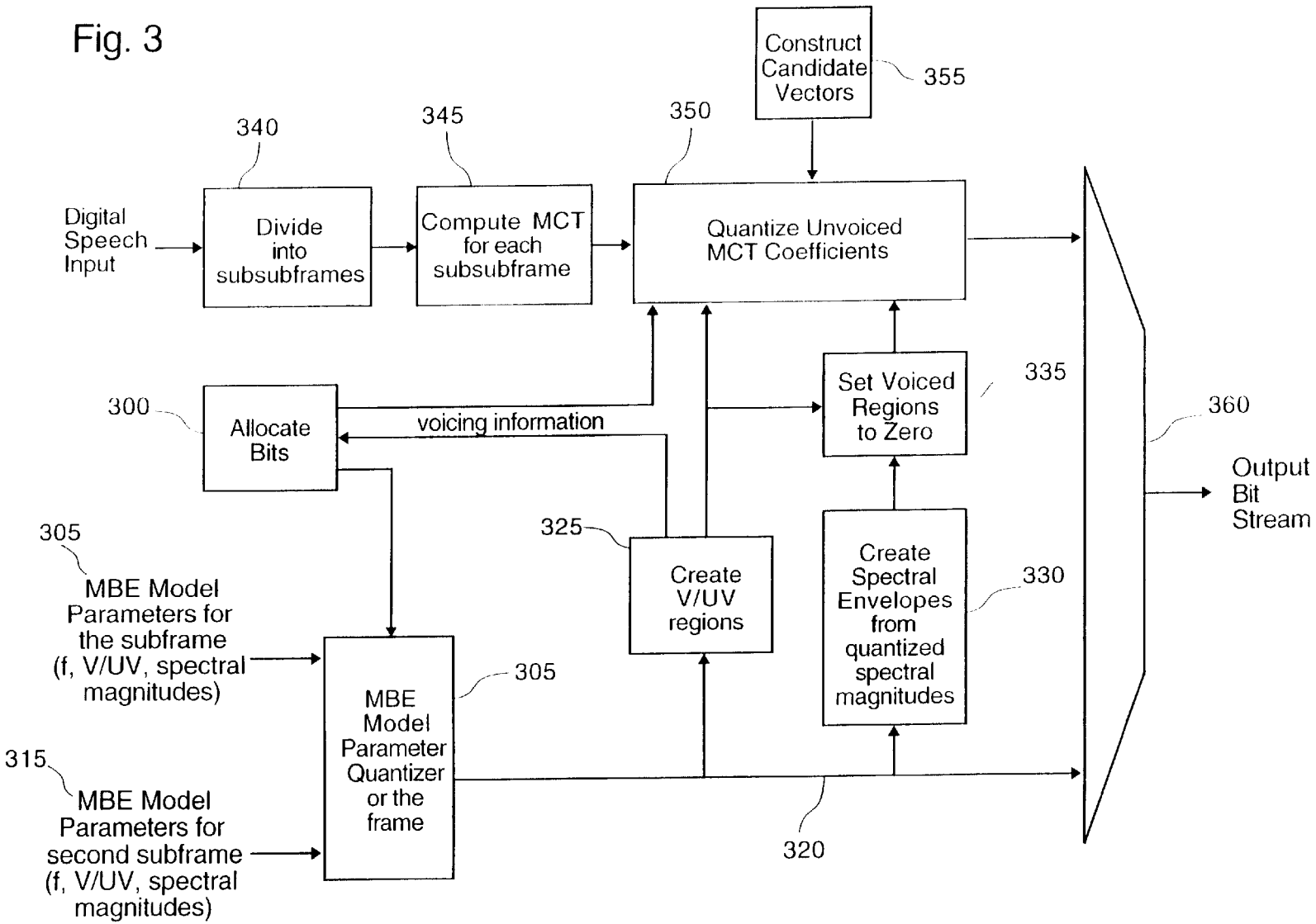

Referring also to FIG. 3, the quantization block 115 includes a bit allocation element 300 that uses the quantized voicing information to divide the number of available bits between the MBE model parameter bits and the MCT coefficient bits. An MBE model parameter quantizer 305 uses the allocated number of bits to quantize MBE model parameters 310 for the first subframe of a frame and MBE model parameters 315 for the second subframe of the frame to produce quantized model parameter bits 320. The quantized model parameter bits 320 are processed by a V/UV element 325 to construct the voicing information and to identify the voiced and/or unvoiced regions of the frame. The quantized model parameter bits 320 are also processed by a spectral envelope element 330 to create a spectral envelope of each subframe. An element 335 further processes the spectral envelope for a subframe using the output of the V/UV element to set the spectral envelope to zero in voiced regions.

An element 340 of the quantization block receives the digital speech input and divides it in to into subframes and/or subsubframes. Each subframe or subsubframe is transformed by a modified cosine transform (MCT) 345 to produce MCT coefficients.

An MCT coefficient quantizer 350 uses an allocated number of bits to quantize MCT coefficients for unvoiced regions. The MCT coefficient quantizer 350 does this using candidate vectors constructed by an element 355.

Figure 4:
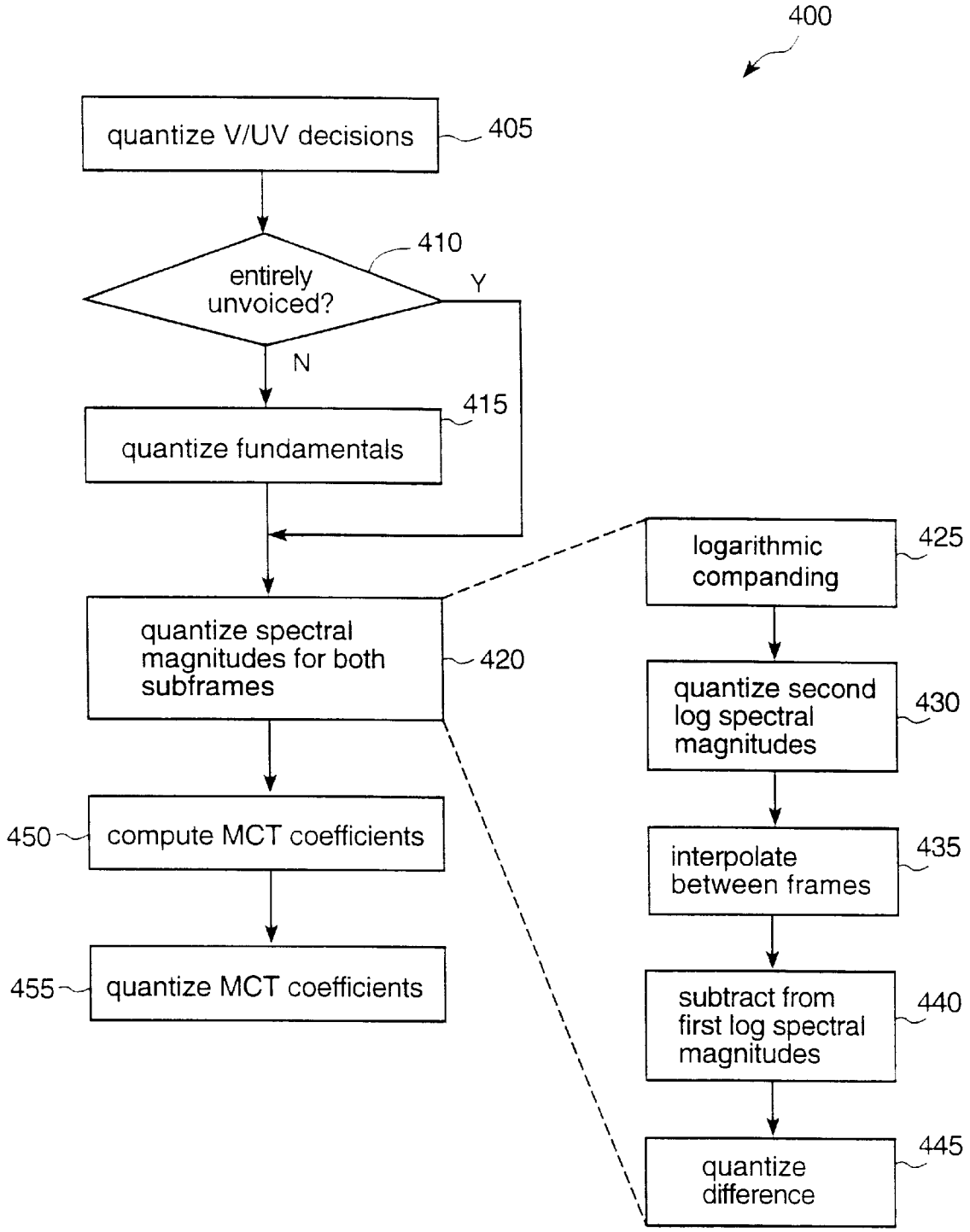

Referring to FIG. 4, the quantization may proceed according to a procedure 400 in which the encoder first quantizes the voiced/unvoiced decisions (step 405). For example, a vector quantization method described in U.S. patent application No. 08/985,262, which is incorporated by reference, may be used to jointly quantize the voicing decisions using a small number of bits (typically 3–8). Alternatively, performance may be increased by applying variable length coding to the voicing decisions, where only a single bit is used to represent frames that are entirely unvoiced and additional voicing bits are used only if the frame is at least partially voiced. The voicing decisions are quantized first since they influence the bit allocation for the remaining components of the frame.

Assuming that the frame is not entirely unvoiced (step 410), then the encoder uses the next (typically 6–16) bits to quantize the fundamental frequencies for the subframes (step 415). In one implementation, the fundamental frequencies from the two subframes are quantized jointly using the method disclosed in U.S. patent application Ser. No. 08/985,262. In another implementation, used primarily when only a single fundamental frequency is estimated per frame, the fundamental frequency is quantized using a scalar log uniform quantizer over a pitch range of approximately 19 to 123 samples. However, if the frame is entirely unvoiced, then no bits are used to quantize the fundamental frequency, since the default unvoiced fundamental frequency is known by both the encoder and the decoder.

Next, the encoder quantizes the sets of spectral magnitudes for the two subframes of the frame (step 420). For example, the encoder may convert them into the log domain using logarithmic companding (step 425), and then may use a combination of prediction, block transforms, and vector quantization. One approach is to first quantize the second log spectral magnitudes (i.e., the log spectral magnitudes for the second subframe) (step 430) and to then interpolate between the quantized second log spectral magnitudes for both the current frame and the prior frame (step 435). These interpolated amplitudes are then subtracted from the first log spectral magnitudes (i.e., the log spectral magnitudes for the first subframe) (step 440) and the difference is quantized (step 445). Using both this quantized difference and the second log spectral magnitudes from both the prior frame and the current frame, the decoder is able to repeat the interpolation, add the difference, and thereby reconstruct the quantized first log spectral magnitudes for the current frame.

Figure 5:
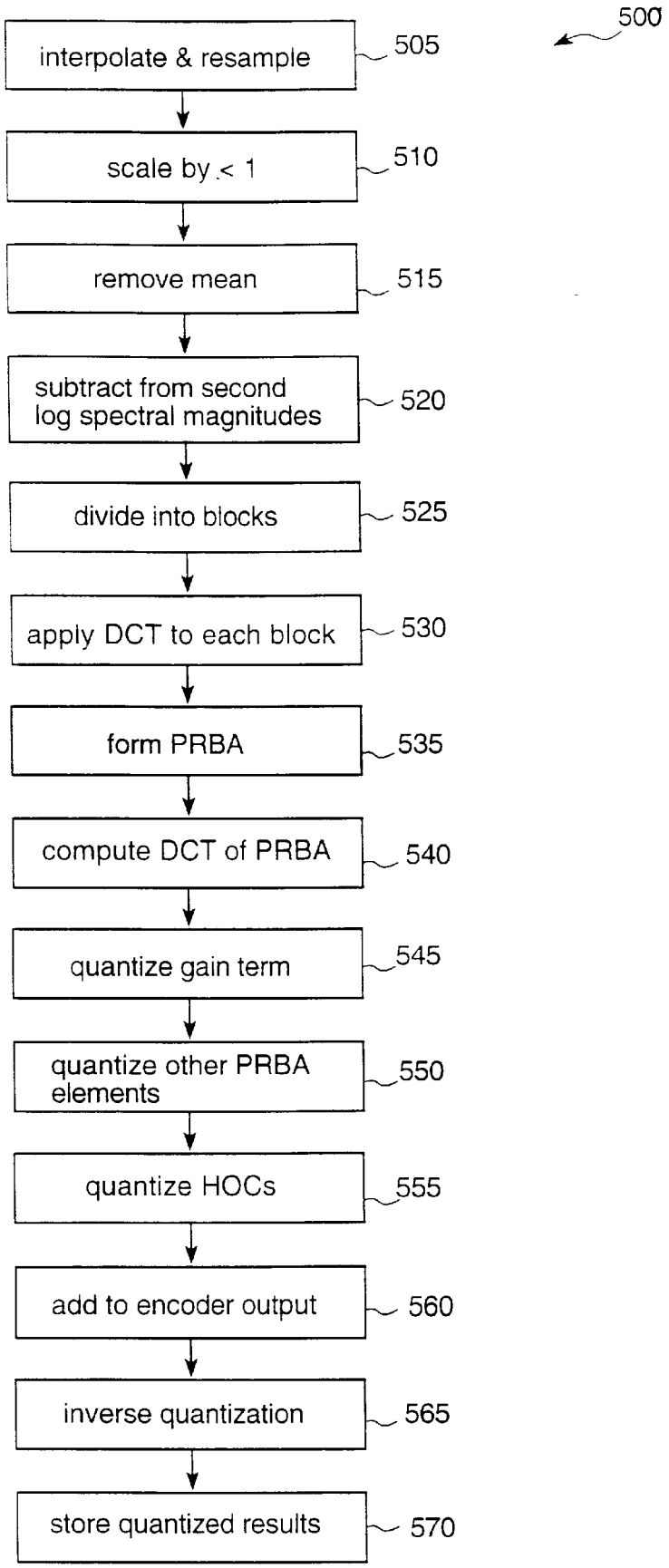

The second log spectral magnitudes may be quantized (step 430) according to the procedure 500 illustrated in FIG. 5, which includes estimating a set of predicted log magnitudes, subtracting the predicted magnitudes from the actual magnitudes, and then quantizing the resulting set of prediction residuals (i.e., the differences). According to the procedure 500, the predicted log amplitudes are formed by interpolating and resampling previously-quantized second log spectral magnitudes from the prior frame (step 505). Linear interpolation is applied with resampling at multiples of the ratio between the fundamental frequencies for the second subframes of the previous frame and the current frame. This interpolation compensates for changes in the fundamental frequency between the two subframes.

The predicted log amplitudes are scaled by a value less than unity (0.65 is typical) (step 510) and the mean is removed (step 515) before they are subtracted from the second log spectral magnitudes (step 520). The resulting prediction residuals are divided into a small number of blocks (typically 4) (step 525). The number of spectral magnitudes, which equals the number of prediction residuals, varies from frame to frame depending on the bandwidth (typically 3.5–4 kHz) divided by the fundamental frequency. Since, for typical human speech, the fundamental frequency varies between about 60 and 400 Hz, the number of spectral magnitudes is allowed to vary over a similarly wide range (9 to 56 is typical), and the quantizer accounts for this variability.

After the prediction residuals are divided into blocks (step 525), a Discrete Cosine Transform (DCT) is applied to the prediction residuals in each block (step 530). The size of each block is set as a fraction of the number of spectral magnitudes for the pair of subframes, with the block sizes typically increasing from low frequency to high frequency, and the sum of the block sizes equaling the number of spectral magnitudes for the pair of subframes, (0.2, 0.225, 0.275, 0.3 are typical fractions with four blocks). The first two elements from each of the four blocks are then used to form an eight-element prediction residual block average (PRBA) vector (step 535). The DCT then is computed for the PRBA vector (step 540). The first (i.e., DC) coefficient is regarded as the gain term, and is quantized separately, typically with a 4–7 bit scalar quantizer (step 545). The remaining seven elements in the transformed PRBA vector are then vector quantized (step 550), where a 2–3 part split vector quantizer is commonly used (typically 9 bits for the first three elements plus 7 bits for the last four elements).

Once the PRBA vector is quantized in this manner, the remaining higher order coefficients (HOCs) from each of the four DCT blocks are quantized (step 555). Typically, no more than four HOCs from any block are quantized. Any additional HOCs are set equal to zero and are not encoded. The HOC quantization is typically done with a vector quantizer using approximately four bits per block.

Once the PRBA and HOC elements are quantized in this manner, the resulting bits are added to the encoder output bits for the current frame (step 560), and the steps are reversed to compute at the encoder the quantized spectral magnitudes as seen by the decoder (step 565). The encoder stores these quantized spectral magnitudes (step 570) for use in quantizing the first log spectral magnitudes of the current frame and for subsequent frames to only use information available to both the encoder and the decoder. In addition, these quantized spectral magnitudes may be subtracted from the unquantized second log spectral magnitudes and this set of spectral errors may be further quantized if more precise quantization is required. Methods for quantizing the second log spectral magnitudes are discussed further in U.S. Pat. No. 5,226,084 and U.S. patent application Ser. Nos. 08/818,130 and 08/818,137, which are incorporated by reference.

Figure 6:
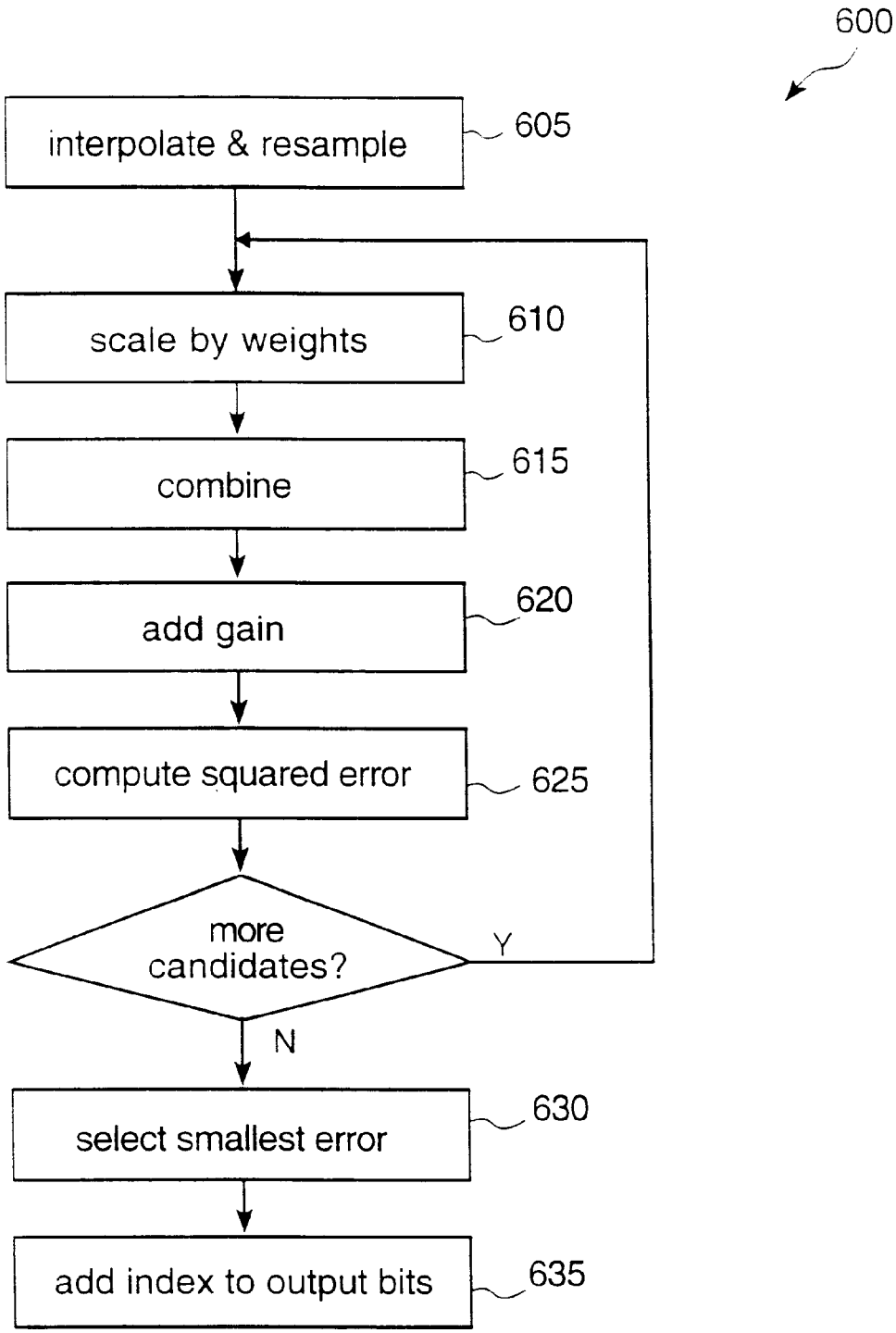

Referring to FIG. 6, the quantization of the first log spectral magnitudes is accomplished according to a procedure 600 that includes interpolating between the quantized second log spectral magnitudes for both the current frame and the prior frame. Typically, some small number of different candidate interpolated spectral magnitudes are formed using three parameters consisting of a pair of non-negative weights and a gain term. Each of the candidate interpolated spectral magnitudes are compared against the unquantized first log spectral magnitudes and the one which yields the minimum squared error is selected as the best candidate.

The different candidate interpolated spectral magnitudes are formed by first interpolating and resampling the previously-quantized second log spectral magnitudes for both the current and prior frame to account for changes in the fundamental frequency between the three subframes (step 605). Each of the candidate interpolated spectral magnitudes then is formed by scaling each of the two resampled sets by one of the two weights (step 610), adding the scaled sets together (step 615), and adding the constant gain term (step 620). In practice, the number of different candidate interpolated spectral magnitudes that are computed is equal to some small power of two (e.g., 2, 4, 8, 16, or 32), with the weights and gain terms being stored in a table of that size. Each set is evaluated by computing the squared error between it and the first log spectral magnitudes which are being quantized (step 625). The set of interpolated spectral magnitudes which produces the smallest error is selected (step 630) and the index into the table of weights is added to the output bits for the current frame (step 635).

The selected set of interpolated spectral magnitudes then are subtracted from the first log spectral magnitudes being quantized to produce a set of spectral errors (step 640). As discussed below, this set of spectral errors may be further quantized for more precision.

More precise quantization of the model parameters can be achieved in many ways. However, one method which is advantageous in certain applications is to use multiple layers of quantization, where the second layer quantizes the error between the unquantized parameter and the result of the first layer, and additional layers work in a similar manner. This hierarchical approach may be applied to the quantization of the spectral magnitudes, where a second layer of quantization is applied to the spectral errors computed as a result of the first layer of quantization described above. For example, in one implementation, a second quantization layer is achieved by transforming the spectral errors with a DCT and using a vector quantizer to quantize some number of these DCT coefficients. A typical approach is to use a gain quantizer for the first coefficient plus split vector quantization of the subsequent coefficients.

A second level of quantization may be performed on the spectral errors by first adaptively allocating the desired number of additional bits depending on the quantized prediction residuals computed during the reconstruction of the quantized second log spectral magnitudes for the current frame. In general, more bits are allocated where the prediction residuals are larger, typically adding one extra bit whenever the residual (which is in the log domain) increases by a certain amount (such as 0.67). This bit allocation method differs from prior techniques in that the bit allocation is based on the prediction residuals rather than on the log spectral magnitudes themselves. This has the advantage of eliminating the sensitivity of the bit allocation to bit errors in prior frames, which results in higher performance in noisy communication channels.

Once the additional bits are allocated in this manner, vector quantization is applied to each small block of consecutive spectral errors (typically 4 per block). Different-sized vector quantization ("VQ") tables are applied depending on the number of bits allocated to each block. However, the maximum VQ table size is limited so that excessively large tables are not required. A third layer of scalar quantization to the VQ error is applied if the number of allocated bits exceeds the maximum VQ size. Furthermore, to further reduce storage requirements, a single maximum sized VQ table can be used with reduced searching when the number of allocated bits is less than the maximum.

Referring again to FIG. 4, once the spectral magnitudes for both subframes have been quantized (step 445), the encoder computes a modified cosine transform (MCT) or other spectral transform of the speech for each subframe (step 450). One important advance is the use of a critically-sampled, overlapped transform, such as the MCT based on time domain aliasing cancellation (TDAC) described by Princen and Bradley. This transform computes a transform $S_i(k)$ for 0<=k<K/2 from the i'th subframe of the digital speech input s(k):

$$S_i(k) = \frac{2}{K}\sum_{n=0}^{K-1} s\left(i\frac{K}{2}+n\right)w(n)\cos\left[\frac{2\pi}{K}\left(k+\frac{1}{2}\right)\left(n+\frac{1}{2}+\frac{K}{4}\right)\right]$$

where K/2 is the size of the transform and is typically equal to the subframe size. The window function w(n) for 0<=n<K is constrained to provide for up to 50% overlap between the window applied to neighboring subframes:

$$w^2(n) + w^2\left(n+\frac{K}{2}\right) = 1$$

Various window functions, which are symmetric (i.e., w(n)= w(K−1−n)), and which meet the constraint can be used. One such window function is the half sine function:

$$w(n) = \sin\left[\frac{\pi}{K}\left(n+\frac{1}{2}\right)\right], 0 \le n < K$$

The MCT or similar transform is typically used to represent unvoiced speech, due to its desirable properties for this purpose. The MCT is a member of a class of overlapped orthogonal transforms that are capable of perfect reconstruction while maintaining critical sampling. These properties are quite significant for a number of reasons. First, an overlapping window allows smooth transitions between subframes, eliminates audible noise at the subframe rate, and enables good voiced/unvoiced transitions. In addition, the perfect reconstruction property prevents the transform itself from introducing any artifacts into the decoded speech. Finally, critical sampling maintains the same number of transform coefficients as input samples, thereby leaving more bits available to quantize each coefficient.

Figure 7:
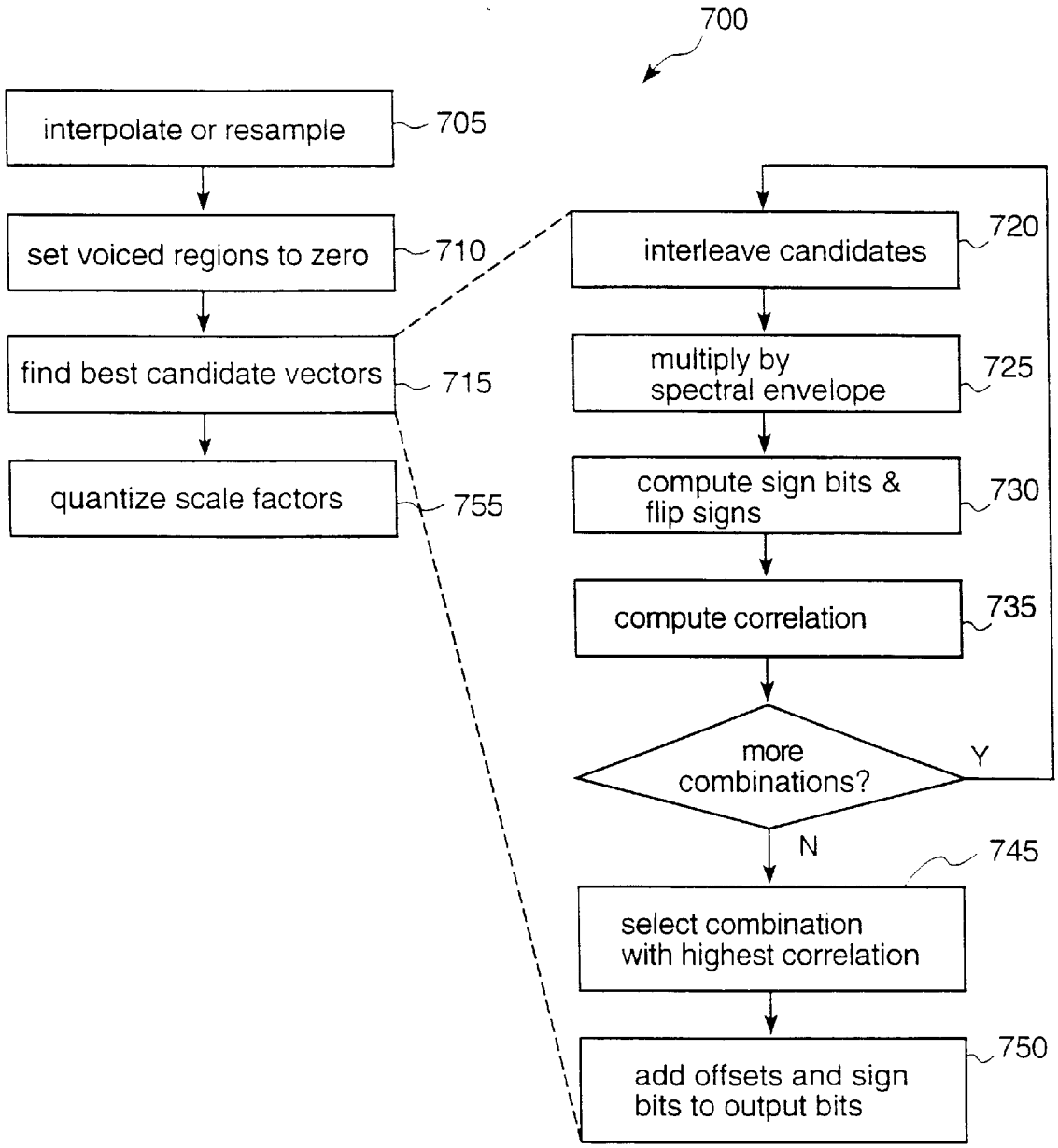

The encoder generates the spectral transform according to the procedure 700 illustrated in FIG. 7. For each subframe, the quantized set of log spectral magnitudes is interpolated or resampled to match the center of each MCT bin (step 705). This creates a spectral envelope, $H_i(k)$ for 0<=k<K/2, for the i'th MCT subframe:

$$p_k = \left(k+\frac{1}{2}\right)\Big/(Kf)$$

$$l_k = \lfloor p_k \rfloor$$

$$H_i(k) = \exp[1 + l_k - p_k)\log M_{l_k} + (p_k - l_k)\log M_{l_{k+1}}$$

where f is the quantized fundamental frequency for that subframe and log $m_1$ for 0<=1<=L are the quantized log spectral magnitudes for that subframe. Next, the spectral envelope is set to zero (or significantly attenuated) for any bin which is in a voiced frequency region as determined by the voicing decisions and fundamental frequencies for that subframe (step 710).

Referring also to FIG. 4, the MCT coefficients then are quantized (step 455) using a vector quantizer that searches for a combination of one or more candidate vectors which, when interleaved together and multiplied by the computed spectral envelope, maximize the correlation against the actual MCT coefficients for that subframe (step 715). The candidate vectors are constructed from an offset into a long prototype vector and by a predetermined number of sign bits which scale every M'th element of the vector by +/−1 (where M is the number of sign bits per candidate vector). Typically, the number of possible offsets for a candidate vector is limited to a reasonable number, such as 256 (i.e., 8 bits), and any additional bits are used as sign bits. For example, if eleven bits are to be used for a candidate vector, eight bits would be used for the offset and the remaining three bits would be sign bits, with each sign bit either inverting or not inverting the sign of every third element of the candidate vector.

Next, interleaving is used to combine all of the candidate vectors for a subframe (step 720). Each successive element in a candidate vector is interleaved to every N'th MCT bin, where N is the number of candidate vectors. In a typical implementation, there are two candidate vectors (N=2), which are interleaved into the even and odd MCT bins, and the number of elements in each candidate vector is half the size of the subframe in samples. The interleaved candidate vectors are then multiplied by the spectral envelope (step 725) and scaled by a quantized scale factor $\alpha_i$ to reconstruct the MCT coefficients for each subframe.

Sign bits then are computed and signs are flipped (step 730). Once this is done, a correlation is computed (step 735). If there are no more combinations of candidate vectors to be considered (step 740), the combination with the highest correlation is selected (step 745) and the offset and sign bits are added to the output bits (step 750).

The process of finding the best candidate vectors for any subframe requires that each possible combination of N candidate vectors be scaled by the spectral envelope and compared against the unquantized MCT coefficients until the possibility with the highest correlation is found. Searching all possible combinations of N candidate vectors requires that for each candidate, all possible offsets into the prototype vector and all possible sign bits are considered. However, in the case of the sign bits, it is possible to determine the best setting for each sign bit by setting it so that the elements affected by that bit are positively correlated with the corresponding unquantized MCT coefficients, leaving only the possible offsets to be searched.

In the event that the processing time is insufficient for a full search of all possible offsets, a partial search process can be used to find a good combination of N candidate vectors at a much lower complexity. A partial search process used in one implementation preselects the best few (3–8) possibilities for each candidate vector, tries all combinations of the preselected candidate vectors, and selects the combination with the highest correlation as the final selection. The bits used to encode the selected combination include the offset bits and the sign bits for each of the N candidate vectors interleaved into that combination.

Once the best possible combination of candidate vectors has been selected (step 715), then a scale factor a i for the i'th subframe is computed (step 755) to minimize the mean square error between the unquantized MCT coefficients and the selected candidates vectors:

$$a_i = \frac{\sum_{k=0}^{K/2-1} C_i(k)H_i(k)S_i(k)}{\sum_{k=0}^{K/2-1} [C_i(k)H_i(k)]^2}$$

where $C_i(k)$ represents the combined candidate vectors, $H_i(k)$ is the spectral envelope, and $S_i(k)$ is the unquantized MCT coefficients for the i'th subframe.

These scale factors are then quantized in pairs (step 720), typically with a vector quantizer that uses a small number of bits (e.g., 1–6) per pair. Typically, when more or less bits are available to quantize the MCT coefficients, the number of bits allocated to each candidate vector (typically two per subframe) and to the scale factors (typically one per subframe) is adjusted up or down, respectively. This allows the method to accommodate a variable number of bits, which improves quality and allows variable rate operation as discussed below.

Referring again to FIG. 1, after performing quantization, the encoder may optionally process the quantized bits with a forward error control (FEC) coder 120 to produce output bits 125 for a frame. These output bits may be, for example, transmitted to a decoder or stored for later processing. A combiner 360 combines the quantized MCT coefficient bits and the quantized model parameter bits to produce the output bits for the frame.

As an example of operation at 4000 bps, the encoder divides the input digital speech signal into 20 ms frames consisting of 160 samples at an 8 kHz sampling rate. Each frame is further divided into two 10 ms subframes. Each frame is encoded with 80 bits of which some or all are used to quantize the MBE model parameters as shown in Table 1. Two separate cases are considered depending on whether the frame is entirely unvoiced (i.e., the All Unvoiced Case) or if the frame is partially voiced (i.e., the Some Voiced Case). The first voicing bit, designated the All Unvoiced Bit, indicates to the decoder which case is being used for the frame. Remaining bits are then allocated as shown in Table 1 for the appropriate case.

In the All Unvoiced Case, no additional bits are used for the voicing information or for the fundamental frequency. In the Some Voiced Case, three additional bits are used for voicing and seven bits are used for the fundamental frequency.

The gain term is either quantized with four bits or six bits, while the PRBA vector is always quantized with a nine bit plus a seven bit split vector quantizer for a total of sixteen bits. The HOCs are always quantized with four 4-bit quantizers (one per block) for a total of sixteen bits. In addition, the Some Voice Case uses three bits for selecting the interpolation weights and gain term that best match the first log spectral magnitudes.

| Bit Allocation | All unvoiced Case | Some Voiced Case |
|---|---|---|
| All Unvoiced Bit | 1 | 1 |
| Additional Voicing Bits | 0 | 3 |
| Fundamental Frequency Bits | 0 | 7 |
| Gain Bits | 4 | 6 |
| PRBA Bits | 9 + 7 = 16 | 9 + 7 = 16 |

-continued

| Bit Allocation | All unvoiced Case | Some Voiced Case |
|---|---|---|
| HOC Bits | 4 * 4 = 16 | 4 * 4 = 16 |
| Interpolation Weights | 0 | 3 |
| Total | 37 | 52 |

The total bits per frame used to quantize the model parameters in the All Unvoiced Case is 37, leaving 43 bits for the MCT coefficients. In this case, 39 bits are used to indicate the offset and sign bits for the combination of four candidate vectors which are selected (two candidates per subframe, with eight offset bits per candidate, two sign bits for three candidates, and one sign bit for the fourth candidate), while the final four bits are used to quantize the associated MCT scale factors using two 2-bit vector quantizers.

In the Some Voiced Case, 52 bits per frame are used to quantize the model parameters. The remaining 28 bits are divided between the MCT coefficients and additional layers of quantization for the spectral magnitudes. Bit allocation is performed by using the rules:

Number of MCT Bits=28* (# of unvoiced bands)/6, but not more than 28;

Number of Additional Spectral Magnitude Bits=28–Number of MCT Bits.

Any additional bits assigned in this manner to the spectral magnitudes are used to quantize the error between the unquantized and quantized spectral magnitudes for the frame. Bit allocation among the spectral magnitudes is based on the quantized prediction residuals for the second log spectral magnitudes of the current frame. Any bits assigned to the MCT coefficients are divided with 90% used to indicate the offsets of the four selected candidate vectors per frame (no sign bits are used in this case since the number of offset bits available is always less than nine per candidate vector), and the remaining 10% used to quantize the MCT scale factors via two vector quantizers each using zero, one, or two bits.

The method of representing and quantizing unvoiced sounds with transform coefficients is subject to many variations. For example, various other transforms can be substituted for the MCT described above. In addition, the MCT or other transform coefficients can be quantized with various methods including use of adaptive bit allocation, scalar quantization, and vector quantization (including algebraic, multi-stage, split VQ or structured codebook) techniques. In addition, the frame structure of the MCT coefficients can be changed such that they do not share the same subframe structure as the model parameters (i.e., one set of subframes for the MCT coefficients and another set of subframes for the model parameters). In one important variation, each subframe is divided into two subsubframes, and a separate MCT transform is applied to each subsubframe. Half as many bits are then used to quantize each subsubframe using the same approach as described above. The two scale factors computed for the subframe (one scale factor per each of the two subsubframes of the subframe) are then vector quantized together. An advantage of this approach is that it is less complex and it results in better time resolution in the unvoiced speech where it is most needed, without increasing the number of model parameters.

The techniques include further refinements, such as attenuating the spectral envelope or setting it to zero in low frequency unvoiced regions. Typically, setting the spectral envelope to zero for the first few hundred Hertz (200–400 Hz is typical) results in improved performance since unvoiced energy is not perceptually important in this frequency range, while background noise tends to be prevalent. Furthermore, the techniques are well suited to application of noise removal methods that can operate on the MCT coefficients and spectral magnitudes and take advantage of the voicing information available at the encoder.

In addition, the techniques feature the ability to operate in either a fixed rate or variable rate mode. In a fixed rate mode, each frame is designed to use the same number of bits (i.e., 80 bits per 20 ms frame for a 4000 bps vocoder), while in a variable rate mode, the encoder selects the rate (i.e., the number of bits per frame) from a set of possible options. In the variable rate case, the selection is done by the encoder to try to achieve a low average rate, while using more bits for difficult to code frames to achieve higher quality. Rate selection may be based on a number of signal measurements to achieve the highest quality at the lowest average rate, and may be enhanced further by incorporating optional voice/silence discrimination. The techniques accommodate either fixed or variable rate operation due to this bit allocation method.

The techniques allocate bits to try to make effective use of all available bits without incurring excessive sensitivity to bit errors which may have occurred in the previous frames. Bit allocation is constrained by the total number of bits for the current frame and is considered as parameter supplied to both the encoder and decoder. In the case of fixed rate operation, the total number of bits is a constant determined by desired bit rate and the frame size, while in the case of variable rate operation the total bits are set by the rate selection algorithm, so in either case it case be considered as an externally supplied parameter. The encoder subtracts from the total bits the number of bits used initially to quantize the MBE model parameters, including the voicing decisions, the fundamental frequency (zero if all unvoiced), and the first layer of quantization for the sets of spectral magnitudes. The remaining bits are then used for additional layers of quantization for the spectral magnitudes, for quantizing the subframe MCT coefficients, or for both. When the frame is entirely unvoiced, all of the remaining bits typically are applied to the MCT coefficients. When the frame is entirely voiced, all of the remaining bits typically are allocated to additional layers of quantization for the spectral magnitudes or other MBE model parameters. When the frame is partially voiced and unvoiced, the remaining bits are generally split in relative proportion to the number of voiced and unvoiced frequency bands in the frame. This process allows the remaining bits to be used where they are most effective in achieving high voice quality, while basing the bit allocation on information previously coded within the frame to eliminate sensitivity to bit errors in previous frames.

Figure 8:
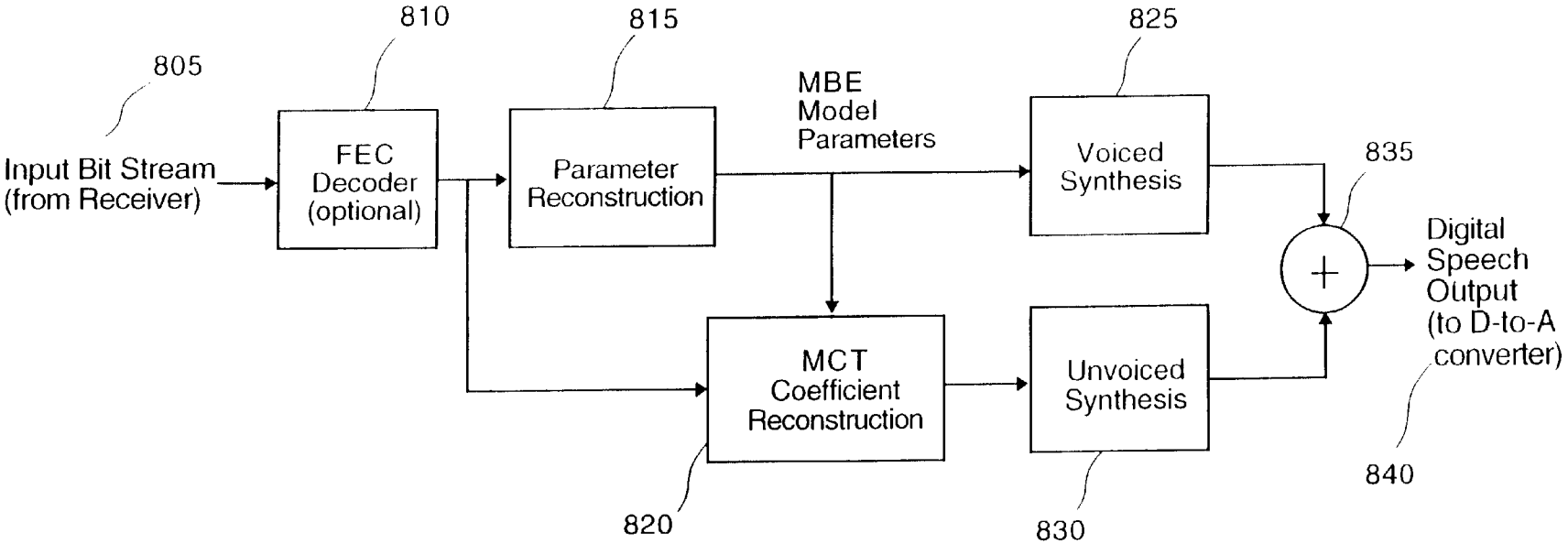
FIG. 8 is a simplified block diagram of a speech decoder.

Referring to FIG. 8, a decoder 800 processes an input bit stream 805. The input bit stream 805 includes sets of bits generated by the encoder 100. Each set corresponds to an encoded frame of the digital signal 105. The bit stream may be produced, for example, by a receiver that receives bits transmitted by the encoder, or retrieved from a storage device.

When the encoder 100 has encoded the bits using an FEC coder, the set of input bits for a frame is supplied to an FEC decoder 810. The FEC decoder 810 decodes the bits to produce a set of quantized bits.

The decoder performs parameter reconstruction 815 on the quantized bits to reconstruct the MBE model parameters for the frame. The decoder also performs MCT coefficient reconstruction 820 to reconstruct the transform coefficients corresponding to the unvoiced portion of the frame.

Once all parameters have been reconstructed for a frame, the decoder separately performs a voiced synthesis 825 and an unvoiced synthesis 830. The decoder then adds 835 the results to produce a digital speech output 840 for the frame which is suitable for playback through a digital-to-analog converter and a loudspeaker.

The operation of the decoder is generally the inverse of the encoder in order to reconstruct the MBE model parameters and the MCT coefficients for each subframe from the bits output by the encoder, and to then synthesize a frame of speech from the reconstructed information. The decoder first reconstructs the excitation parameters consisting of the voicing decisions and the fundamental frequencies for all the subframes in the frame. In the case where only a single set of voicing decisions and a single fundamental frequency are estimated encoded for the entire frame, then the decoder interpolates with like data received for the prior frame to reconstruct a fundamental frequency and voicing decisions for intermediate subframes in the same manner as the encoder. Also, in the event that the voicing decisions indicate that the frame is entirely unvoiced, the decoder sets the fundamental frequency to the default unvoiced value. The decoder next reconstructs all of the spectral magnitudes by inverting the quantization process used by the encoder. The decoder is able to recompute the bit allocation as performed by the encoder, so all layers of quantization used by the encoder can be used by the decoder in reconstructing the spectral magnitudes.

Once the model parameters for the frame are reconstructed, the decoder regenerates the MCT coefficients for each subframe (or subsubframe in the case where more than one MCT transform is performed per subframe). The decoder reconstructs a spectral envelope for each subframe in the same way that the encoder did. The decoder then multiplies this spectral envelope by the interleaved candidate vectors indicated by the encoded offsets and sign bits. Next, the decoder scales the MCT coefficients for each subframe by the appropriate decoded scale factor. The decoder then computes an inverse MCT using a TDAC window w(n) to produce the output $y_i(n)$ for the i'th subframe:

$$y_i(n) = 2\sum_{k=0}^{K/2-1} S_i(k)w(n)\cos\left[\frac{2\pi}{K}\left(k+\frac{1}{2}\right)\left(n+\frac{1}{2}+\frac{K}{4}\right)\right]$$

This process is repeated for each subframe (or subsubframe) and the inverse MCT results from consecutive subframe are then combined using overlap-add with the correct alignment between subframes (offsetting each by K/2 relative to the previous subframe) to reconstruct the unvoiced signal for that frame.

The voiced signal is then synthesized separately by the decoder using a bank of harmonic oscillators with one oscillator assigned to each harmonic. In the typical case, the voiced speech is synthesized one subframe at a time in order to coincide with the representation used for the model parameters. A synthesis boundary then occurs between each subframe, and the voiced synthesis method must ensure that no audible discontinuities are introduced at these subframe boundaries. This continuity condition forces each harmonic oscillator to interpolate between the model parameters representing successive subframes.

The amplitude of each harmonic oscillator is normally constrained to be a linear polynomial. The parameters of the linear amplitude polynomial are set such that the amplitude is interpolated between corresponding spectral magnitudes across the subframe. This generally follows a simple ordered assignment of the harmonics (e.g., the first oscillator interpolates between the first spectral magnitudes in the prior and current subframe, the second oscillator interpolates between the second spectral magnitude in the current and prior subframe, and so on until all spectral magnitudes are used). However, in certain cases, including transitions to/from an unvoiced frequency band, if the number of spectral magnitudes in the two sets is unequal, or if the fundamental frequency changes too much between subframes, then the amplitude polynomial is matched to zero at one end or the other rather than to one of the spectral magnitudes.

Similarly, the phase of each harmonic oscillator is constrained to be a quadratic or cubic polynomial and the polynomial coefficients are selected such that the phase and its derivative are matched to the desired phase and frequency values at both the beginning and ending subframe boundary. The desired phases at the subframe boundaries are determined either from explicitly transmitted phase information or by a number of phase regeneration methods. The desired frequency at the subframe boundaries for the l'th harmonic oscillator is simply equal to 1 times the fundamental. The output of each harmonic oscillator is summed for each subframe in the frame, and the result is then added to the unvoiced speech to complete the synthesized speech for the current frame. Complete details of this procedure are described in the incorporated references. Repeating this synthesis process for a series of consecutive frames allows a continuous digital speech signal to be produced which is output to a digital-to-analog converter for subsequent playback through a conventional speaker.

Figure 9:
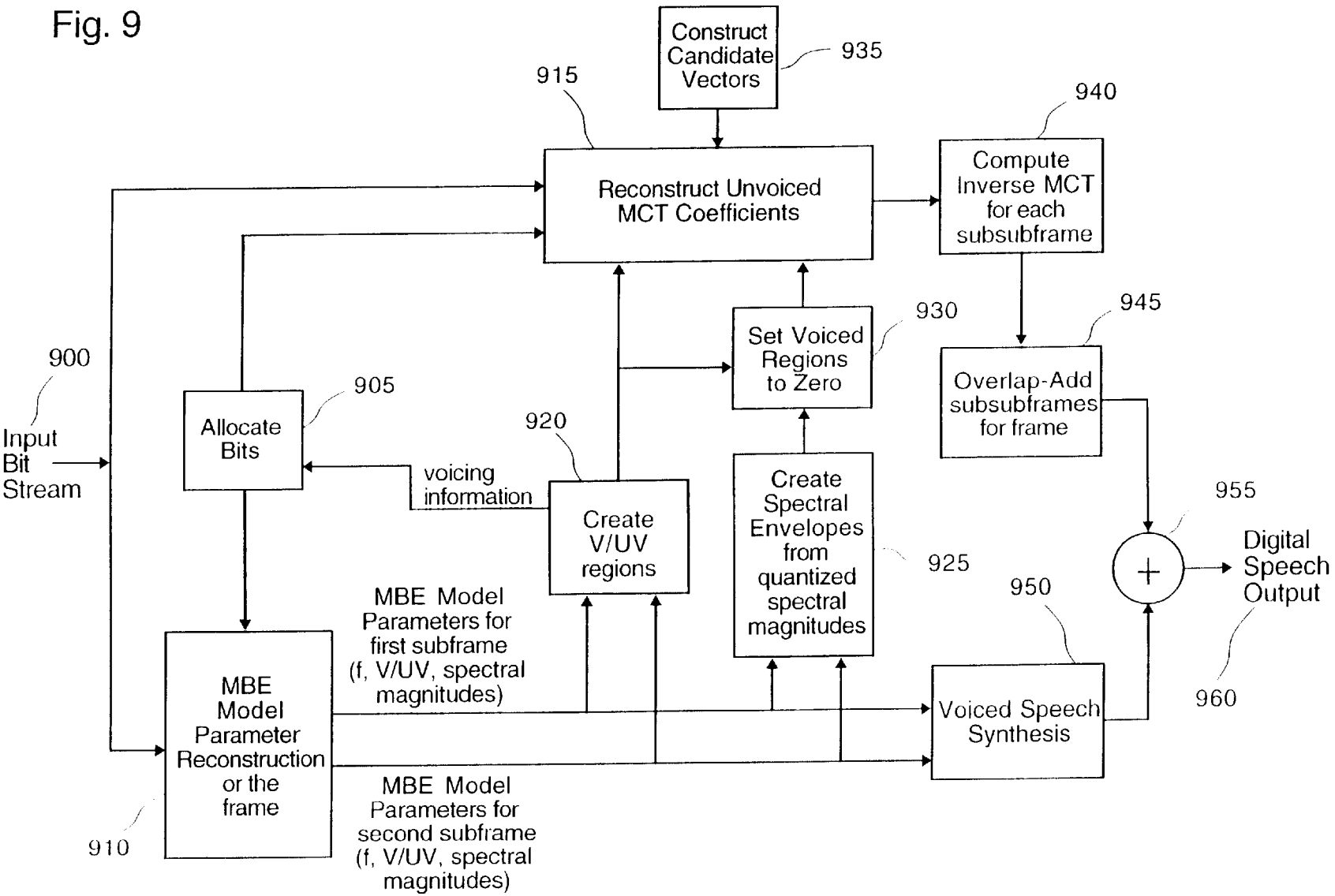
FIG. 9 is a block diagram of reconstruction and synthesis blocks of the speech decoder of FIG. 8.

Operation of the decoder may be summarized with reference to FIG. 9. As shown, the decoder receives an input bit stream 900 for each frame. A bit allocator 905 uses reconstructed voicing information to supply bit allocation information to an MBE model parameter reconstructor 910 and an MCT coefficient reconstructor 915.

The MBE model parameter reconstructor 910 processes the bit stream 900 to reconstruct the MBE model parameters for all of the subframes in the frame using the supplied bit allocation information. A V/UV element 920 processes the reconstructed model parameters to generate the reconstructed voicing information and to identify voiced and unvoiced regions. A spectral envelope element 925 processes the reconstructed model parameters to create a spectral envelope from the spectral magnitudes. The spectral envelope is further processed by an element 930 to set the voiced regions to zero.

The MCT coefficient reconstructor 915 uses the bit allocation information, the identified voicing regions, the processed spectral envelope, and a table of candidate vectors 935 to reconstruct the MCT coefficients from the input bits for each subframe or subsubframe. An inverse MCT 940 then is performed for each subsubframe.

The outputs of the MCT 940 are combined by an overlap-add element 945 to produce the unvoiced speech for the frame.

A voiced speech synthesizer 950 synthesizes voiced speech using the reconstructed MBE model parameters.

Finally, a summer 955 adds the voiced and unvoiced speech to produce the digital speech output 960 which is suitable for playback via a digital-to-analog converter and a loudspeaker.

To achieve high quality synthesized speech, improved techniques are provided for synthesizing transitions between voiced and unvoiced regions. Whenever a harmonic in a subframe changes between voiced and unvoiced, the voiced synthesis procedure sets the amplitude of that harmonic to zero at the subframe boundary corresponding to the unvoiced subframe. This is accomplished by matching the amplitude polynomial to zero at the unvoiced end. The technique differs from prior techniques in that a linear or piecewise linear polynomial is not used for the amplitude polynomial whenever a harmonic undergoes such a voicing transition. Instead, the square of the same MCT window used for synthesizing the unvoiced speech is used. Such use of a consistent window between the voiced and unvoiced synthesis methods assures that transition is handled smoothly without the introduction of additional artifacts.

Many variations in the synthesis procedure are contemplated. One significant variation in the synthesis of the voiced speech is to only use a bank of harmonic oscillators for the first few low frequency harmonics (typically 7) and to then use an inverse FFT with interpolation, resampling and overlap-add to synthesize the voiced speech associated with the remaining high frequency harmonics. This hybrid approach synthesizes high quality voiced speech with lower complexity and is described in detail in U.S. Pat. Nos. 5,581,656 and 5,195,166, which are incorporated by reference.

In addition, phase regeneration can be used at the decoder to produce the phase information necessary for synthesizing the voiced speech without requiring explicit encoding and transmission of any phase information. Typically, such phase regeneration methods compute an approximate phase signal from other decoded model parameters. In one method, which is described in U.S. Pat. Nos. 5,081,681 and 5,664,051, which are incorporated by reference, random phase values are computed using the decoded fundamental frequencies and voicing decisions. In another method, described in U.S. Pat. No. 5,701,390, which is incorporated by reference, the harmonic phases at the subframe boundaries are regenerated at the decoder from the spectral magnitudes by applying a smoothing kernel to the log spectral magnitudes or by performing a minimum phase or similar magnitude-based phase reconstruction. These and other phase regeneration methods allow more bits to be allocated to quantizing other parameters in the frame, thereby reducing distortion and allowing shorter frame sizes with improved time resolution.

Additional details and alternative embodiments for the decoding and speech synthesis methods are provided in the incorporated references.

Other embodiments are within the scope of the following claims.

What is claimed is:

1. A method of encoding a speech signal into a set of encoded bits, the method comprising:

digitizing the speech signal to produce a sequence of digital speech samples;

dividing the digital speech samples into a sequence of frames, each of the frames spanning multiple digital speech samples;

estimating a set of speech model parameters for a frame, wherein the speech model parameters include voicing parameters dividing the frame into voiced and unvoiced regions, at least one pitch parameter representing pitch for at least the voiced regions of the frame, and spectral parameters representing spectral information for at least the voiced regions of the frame;

quantizing the speech model parameters to produce parameter bits;

dividing the frame into one or more subframes and computing transform coefficients for the digital speech samples representing the subframes;

quantizing the transform coefficients in unvoiced regions of the frame to produce transform bits; and including the parameter bits and the transform bits in the set of encoded bits.

2. The method of claim 1, wherein the frame is divided into frequency bands, the voicing parameters include binary voicing decisions for frequency bands of the frame, and the division into voiced and unvoiced regions designates at least one frequency band as being voiced and one frequency band as being unvoiced.

3. The method of claim 1, wherein the spectral parameters for the frame include one or more sets of spectral magnitudes estimated for both voiced and unvoiced regions in a manner which is independent of the voicing parameters for the frame.

4. The method of claim 3, wherein the spectral parameters for the frame include two or more sets of spectral magnitudes quantized using a method comprising:

companding all sets of spectral magnitudes in the frame to produce sets of companded spectral magnitudes using a companding operation such as the logarithm;

quantizing the last set of the companded spectral magnitudes in the frame;

interpolating between the quantized last set of companded spectral magnitudes in the frame and a quantized set of companded spectral magnitudes from a prior frame to form interpolated spectral magnitudes;

determining a difference between a set of companded spectral magnitudes and the interpolated spectral magnitudes; and quantizing the determined difference between the spectral magnitudes.

5. The method of claim 4, further comprising computing the spectral magnitudes by:

windowing the digital speech samples to produce windowed speech samples;

computing an FFT of the windowed speech samples to produce FFT coefficients;

summing energy in the FFT coefficients around multiples of a fundamental frequency corresponding to the pitch parameter; and computing the spectral magnitudes as square roots of the summed energies.

6. The method of claim 3, further comprising computing the spectral magnitudes by:

windowing the digital speech samples to produce windowed speech samples;

computing an FFT of the windowed speech samples to produce FFT coefficients;

summing energy in the FFT coefficients around multiples of a fundamental frequency corresponding to the pitch parameter; and computing the spectral magnitudes as square roots of the summed energies.

7. The method of claim 1, wherein the transform coefficients are computed using a transform possessing critical sampling and perfect reconstruction properties.

8. The method of claim 1, 2, 3, 4, 5, 6 or 7, wherein the transform coefficients are computed using an overlapped transform that computes transform coefficients for neighboring subframes using overlapping windows of the digital speech samples.

9. The method of claim 1, 2, 3, 4, 5, 6 or 7, wherein the quantizing of the transform coefficients to produce transform bits includes the steps of:

computing a spectral envelope for the subframe from the model parameters;

forming multiple sets of candidate coefficients, with each set of candidate coefficients being formed by combining one or more candidate vectors and multiplying the combined candidate vectors by the spectral envelope;

selecting from the multiple sets of candidate coefficients the set of candidate coefficients which is closest to the transform coefficients; and including the index of the selected set of candidate coefficients in the transform bits.

10. The method of claim 9, wherein each candidate vector is formed from an offset into a known prototype vector and a number of sign bits, wherein each sign bit changes the sign of one or more elements of the candidate vector.

11. The method of claim 9, wherein the selected set of candidate coefficients is the set from the multiple sets of candidate coefficients with the highest correlation with the transform coefficients.

12. The method of claim 9, wherein the quantizing of the transform coefficients to produce transform bits includes the further steps of:

computing a best scale factor for the selected candidate vectors of the subframe;

quantizing the scale factors for the subframes in the frame to produce scale factor bits; and including the scale factor bits in the transform bits.

13. The method of claim 12, wherein scale factors for different sub frames in the frame are jointly quantized to produce the scale factor bits.

14. The method of claim 13, where the joint quantization uses a vector quantizer.

15. The method of claim 1, 2, 3, 4, 5, 6 or 7, wherein the number of bits in the set of encoded bits for one frame in the sequence of frames is different than the number of bits in the set of encoded bits for a second frame in the sequence of frames.

16. The method of claim 1, 2, 3, 4, 5, 6 or 7, further comprising:

selecting the number of bits in the set of encoded bits, wherein the number may vary from frame to frame; and allocating the selected number of bits between the parameters bits and the transform bits.

17. The method of claim 16, wherein selecting the number of bits in the set of encoded bits for a frame is based at least in part on the degree of change between the spectral magnitude parameters representing the spectral information in the frame and the previous spectral magnitude parameters representing the spectral information in the previous frame, and wherein a greater number of bits is favored when the degree of change is larger while a fewer number of bits is favored when the degree of change is smaller.

18. An encoder for encoding a digitized speech signal including a sequence of digital speech samples into a set of encoded bits, the encoder comprising:

a dividing element that divides the digital speech samples into a sequence of frames, each of the frames including multiple digital speech samples;

a speech model parameter estimator that estimates a set of speech model parameters for a frame, the speech model parameters including voicing parameters dividing the frame into voiced and unvoiced regions, at least one pitch parameter representing pitch for at least the voiced regions of the frame, and spectral parameters representing spectral information for at least the voiced regions of the frame;

a parameter quantizer that quantizes the model parameters to produce parameter bits;

a transform coefficient generator that divides the frame into one or more subframes and computes transform coefficients for the digital speech samples representing the subframes;

a transform coefficient quantizer that quantizes the transform coefficients in unvoiced regions of the frame to produce transform bits; and a combiner that combines the parameter bits and the transform bits to produce the set of encoded bits.

19. The encoder of claim 18, wherein at least one of the dividing element, the speech model parameter estimator, the parameter quantizer, the transform coefficient generator, the transform coefficient quantizer, and the combiner is implemented by a digital signal processor.

20. The encoder of claim 19, wherein the dividing element, the speech model parameter estimator, the parameter quantizer, the transform coefficient generator, the transform coefficient quantizer, and the combiner are implemented by the digital signal processor.

21. The encoder of claim 18, wherein the spectral parameters for the frame include two or more sets of spectral magnitudes, and the parameter quantizer is operable to quantize the spectral magnitude parameters by:

companding all sets of spectral magnitudes in the frame to produce sets of companded spectral magnitudes using a companding operation such as the logarithm;

quantizing the last set of the companded spectral magnitudes in the frame;

interpolating between the quantized last set of companded spectral magnitudes in the frame and a quantized set of companded spectral magnitudes from a prior frame to form interpolated spectral magnitudes;

determining a difference between a set of companded spectral magnitudes and the interpolated spectral magnitudes; and quantizing the determined difference between the spectral magnitudes.

22. The encoder of claim 18, wherein the speech model parameter estimator computes the spectral magnitudes by:

windowing the digital speech samples to produce windowed speech samples;

computing an FFT of the windowed speech samples to produce FFT coefficients;

summing energy in the FFT coefficients around multiples of a fundamental frequency corresponding to the pitch parameter; and computing the spectral magnitudes as square roots of the summed energies.

23. The encoder of claim 18, wherein the transform coefficient generator generates the transform coefficients using an overlapped transform that computes transform coefficients for neighboring subframes using overlapping windows of the digital speech samples.

24. The encoder of claim 18, wherein the transform coefficient quantizer quantizes the transform coefficients to produce the transform bits by:

computing a spectral envelope for the subframe from the model parameters; and forming multiple sets of candidate coefficients, with each set of candidate coefficients being formed by combining one or more candidate vectors and multiplying the combined candidate vectors by the spectral envelope;

selecting from the multiple sets of candidate coefficients the set of candidate coefficients which is closest to the transform coefficients; and including the index of the selected set of candidate coefficients in the transform bits.

25. The encoder of claim 24, wherein the transform coefficient quantizer for each candidate vector from an offset into a known prototype vector and a number of sign bits, wherein each sign bit changes the sign of one or more elements of the candidate vector.

26. A method of decoding a frame of digital speech samples from a set of encoded bits, the method comprising:

extracting model parameter bits from the set of encoded bits;

reconstructing model parameters representing the frame of digital speech samples from the extracted model parameter bits, wherein the model parameters include voicing parameters dividing the frame into voiced and unvoiced regions, at least one pitch parameter representing the pitch information for at least the voiced regions of the frame, and spectral parameters representing spectral information for at least the voiced regions of the frame;

producing voiced speech samples for the frame from the reconstructed model parameters;

extracting transform coefficient bits from the set of encoded bits;

reconstructing transform coefficients representing unvoiced regions of the frame from the extracted transform coefficient bits;

inverse transforming the reconstructed transform coefficients to produce inverse transform samples;

producing unvoiced speech for the frame from the inverse transform samples; and combining the voiced speech for the frame and the unvoiced speech for the frame to produce the decoded frame of digital speech samples.

27. The method of claim 26, wherein the frame is divided into frequency bands, the voicing parameters include binary voicing decisions for frequency bands of the frame, and the division into voiced and unvoiced regions designates at least one frequency band as being voiced and one frequency band as being unvoiced.

28. The method of claim 26, wherein the pitch parameter and the spectral parameters for the frame include one or more fundamental frequencies and one or more sets of spectral magnitudes.

29. The method of claim 28, wherein the voiced speech samples for the frame are produced using synthetic phase information computed from the spectral magnitudes.

30. The method of claim 26, wherein the voiced speech samples for the frame are produced at least in part by a bank of harmonic oscillators.

31. The method of claim 30, wherein a low frequency portion of the voiced speech samples is produced by a bank of harmonic oscillators and a high frequency portion of the voiced speech samples is produced using an inverse FFT with interpolation, wherein the interpolation is based at least in part on the pitch information for the frame.

32. The method of claim 26, wherein the method farther includes:

dividing the frame into subframes;

separating the reconstructed transform coefficients into groups, each group of reconstructed transform coefficients being associated with a different subframe in the frame;

inverse transforming the reconstructed transform coefficients in a group to produce inverse transform samples associated with the corresponding subframe; and overlapping and adding the inverse transform samples associated with consecutive subframes to produce unvoiced speech for the frame.

33. The method of claim 32, wherein the inverse transform samples are computed using the inverse of an overlapped transform possessing both critical sampling and perfect reconstruction properties.

34. The method of claim 26, wherein the reconstructed transform coefficients are produced from the transform coefficient bits by:

computing a spectral envelope from the reconstructed model parameters;

reconstructing one or more candidate vectors from the transform coefficient bits; and forming reconstructed transform coefficients by combining the candidate vectors and multiplying the combined candidate vectors by the spectral envelope.

35. The method of claim 34, wherein a candidate vector is reconstructed from the transform coefficient bits by use of an offset into a known prototype vector and a number of sign bits, wherein each sign bit changes the sign of one or more elements of the candidate vector.

36. A decoder for decoding a frame of digital speech samples from a set of encoded bits, the decoder comprising:

a model parameter extractor that extracts model parameter bits from the set of encoded bits;

a model parameter reconstructor that reconstructs model parameters representing the frame of digital speech samples from the extracted model parameter bits, wherein the model parameters include voicing parameters dividing the frame into voiced and unvoiced regions, at least one pitch parameter representing the pitch information for at least the voiced regions of the frame, and spectral parameters representing spectral information for at least the voiced regions of the frame;

a voiced speech synthesizer that produces voiced speech samples for the frame from the reconstructed model parameters;

a transform coefficient extractor that extracts transform coefficient bits from the set of encoded bits;

a transform coefficient reconstructor that reconstructs transform coefficients representing unvoiced regions of the frame from the extracted transform coefficient bits;

an inverse transformer that inverse transforms the reconstructed transform coefficients to produce inverse transform samples;

an unvoiced speech synthesizer that synthesizes unvoiced speech for the frame from the inverse transform samples; and a combiner that combines the voiced speech for the frame and the unvoiced speech for the frame to produce the decoded frame of digital speech samples.

37. The decoder of claim 36, wherein at least one of the model parameter extractor, the model parameter reconstructor, a voiced speech synthesizer, the transform coefficient extractor, the transform coefficient reconstructor, the inverse transformer, the unvoiced speech synthesizer, and the combiner is implemented by a digital signal processor.

38. The decoder of claim 37, wherein the model parameter extractor, the model parameter reconstructor, a voiced speech synthesizer, the transform coefficient extractor, the transform coefficient reconstructor, the inverse transformer, the unvoiced speech synthesizer, and the combiner are implemented by the digital signal processor.

39. A method of encoding a speech signal into a set of encoded bits, the method comprising:

digitizing the speech signal to produce a sequence of digital speech samples;

dividing the digital speech samples into a sequence of frames, each of the frames spanning multiple digital speech samples;

estimating a set of speech model parameters for a frame, wherein the speech model parameters include a voicing parameter, at least one pitch parameter representing pitch for the frame, and spectral parameters representing spectral information for the frame;

quantizing the model parameters to produce parameter bits;

dividing the frame into one or more subframes and computing transform coefficients for the digital speech samples representing the subframes, wherein computing the transform coefficients comprises using a transform possessing critical sampling and perfect reconstruction properties;

quantizing at least some of the transform coefficients to produce transform bits; and including the parameter bits and the transform bits in the set of encoded bits.

40. A method of decoding a frame of digital speech samples from a set of encoded bits, the method comprising:

extracting model parameter bits from the set of encoded bits;

reconstructing model parameters representing the frame of digital speech samples from the extracted model parameter bits, wherein the model parameters include a voicing parameter, at least one pitch parameter representing pitch information for the frame, and spectral parameters representing spectral information for the frame;

producing voiced speech samples for the frame using the reconstructed model parameters;

extracting transform coefficient bits from the set of encoded bits;

reconstructing transform coefficients from the extracted transform coefficient bits;

inverse transforming the reconstructed transform coefficients to produce inverse transform samples, wherein the inverse transform samples are produced using the inverse of an overlapped transform possessing both critical sampling and perfect reconstruction properties;

producing unvoiced speech for the frame from the inverse transform samples; and combining the voiced speech for the frame and the unvoiced speech for the frame to produce the decoded frame of digital speech samples.

41. A method of encoding a speech signal into a set of encoded bits, the method comprising:

digitizing the speech signal to produce a sequence of digital speech samples;

dividing the digital speech samples into a sequence of frames, each of the frames spanning multiple digital speech samples;

estimating a set of speech model parameters for a frame, wherein the speech model parameters include a voicing parameter, at least one pitch parameter representing pitch for the frame, and spectral parameters representing spectral information for the frame, the spectral parameters including one or more sets of spectral magnitudes estimated in a manner which is independent of the voicing parameter for the frame;

quantizing the model parameters to produce parameter bits;

dividing the frame into one or more subframes and computing transform coefficients for the digital speech samples representing the subframes;

quantizing at least some of the transform coefficients to produce transform bits; and including the parameter bits and the transform bits in the set of encoded bits.

42. A method of decoding a frame of digital speech samples from a set of encoded bits, the method comprising:

extracting model parameter bits from the set of encoded bits;

reconstructing model parameters representing the frame of digital speech samples from the extracted model parameter bits, wherein the model parameters include a voicing parameter, at least one pitch parameter representing pitch information for the frame, and spectral parameters representing spectral information for the frame;

producing voiced speech samples for the frame using the reconstructed model parameters and synthetic phase information computed from the spectral magnitudes;

extracting transform coefficient bits from the set of encoded bits;

reconstructing transform coefficients from the extracted transform coefficient bits;

inverse transforming the reconstructed transform coefficients to produce inverse transform samples;

producing unvoiced speech for the frame from the inverse transform samples; and combining the voiced speech for the frame and the unvoiced speech for the frame to produce the decoded frame of digital speech samples.

* * * * *